US007303379B2

(12) United States Patent
Ebara et al.

(10) Patent No.: US 7,303,379 B2
(45) Date of Patent: Dec. 4, 2007

(54) HORIZONTAL TYPE COMPRESSOR AND AUTOMOBILE AIR CONDITIONER EQUIPPED WITH THE SAME

(75) Inventors: Toshiyuki Ebara, Gunma (JP); Hiroyuki Matsumori, Gunma (JP); Takashi Sato, Saitama (JP); Dai Matsuura, Gunma (JP); Takayasu Saito, Saitama (JP)

(73) Assignee: Sanyo Electric Co., Ltd., Osaka (JP)

( * ) Notice: Subject to any disclaimer, the term of this patent is extended or adjusted under 35 U.S.C. 154(b) by 238 days.

(21) Appl. No.: 10/873,293

(22) Filed: Jun. 23, 2004

(65) Prior Publication Data

US 2005/0069445 A1 Mar. 31, 2005

(30) Foreign Application Priority Data

| | | |
|---|---|---|
| Sep. 30, 2003 | (JP) | 2003-342460 |
| Nov. 5, 2003 | (JP) | 2003-376065 |
| Nov. 5, 2003 | (JP) | 2003-376066 |
| Nov. 19, 2003 | (JP) | 2003-388711 |

(51) Int. Cl.
*F01C 1/30* (2006.01)

(52) U.S. Cl. ..... 418/11; 418/92

(58) Field of Classification Search ..... 418/11, 418/60, 92, 97

See application file for complete search history.

(56) References Cited

U.S. PATENT DOCUMENTS

| | | | | |
|---|---|---|---|---|
| 4,780,067 | A * | 10/1988 | Suzuki et al. | 417/441 |
| 5,242,280 | A * | 9/1993 | Fujio | 418/11 |
| 5,518,381 | A * | 5/1996 | Matsunaga et al. | 418/100 |
| 2004/0165999 | A1 * | 8/2004 | Tadano et al. | 417/312 |

FOREIGN PATENT DOCUMENTS

| | | |
|---|---|---|
| JP | 2-294587 | 12/1990 |

* cited by examiner

*Primary Examiner*—Hoang Nguyen
(74) *Attorney, Agent, or Firm*—Westerman, Hattori, Daniels & Adrian, LLP.

(57) ABSTRACT

An object is to execute sure oil supplying to a second rotary compression element in a horizontal type compressor equipped with the second rotary compression element in which pressure becomes higher than that in an airtight container. A horizontal type rotary compressor of a multi-stage compression system comprises a driving element and a compression mechanism section driven by the driving element in a horizontal type airtight container. The compression mechanism section is constituted of first and second rotary compression elements. A refrigerant compressed by the first rotary compression element is discharged into the airtight container, and the discharged refrigerant of intermediate pressure is further compressed by the second rotary compression element to be discharged. A gist is that an oil supply passage is formed in a cylinder of the second rotary compression element 34 to communicate a low-pressure chamber of the cylinder with a bottom part in the airtight container.

4 Claims, 16 Drawing Sheets

HORIZONTAL TYPE COMPRESSOR AND AUTOMOBILE AIR CONDITIONER EQUIPPED WITH THE SAME

BACKGROUND OF THE INVENTION

The present invention relates to a horizontal type compressor which comprises a driving element in a horizontal type airtight container, and a compression mechanism section driven by the driving element, and compresses a refrigerant at the compression mechanism section to discharge the refrigerant.

A conventional rotary compressor of such a kind, especially a rotary compressor of a multistage compression system which comprises a compression mechanism section constituted of first and second rotary compression elements, is constituted by arranging a driving element in an upper part in a normal vertical type airtight container, and the compression mechanism section driven by a rotary shaft of the driving element in a lower part. A refrigerant gas is sucked through a suction port of the first rotary compression element into a low-pressure chamber side of a cylinder, compressed by operating a roller and a vane, and discharged from a high-pressure chamber side of the cylinder through a discharge port and a discharge muffling chamber into the airtight container. At this time, intermediate pressure is set in the airtight container (e.g., see Japanese Patent Application Laid-Open No. 2-294587).

The refrigerant gas of the intermediate pressure in the airtight container is sucked through a suction port of the second rotary compression element into the low-pressure chamber side of the cylinder, and subjected to compression of a second stage by operating the roller and the vane to become a high-temperature and high-pressure refrigerant gas. The refrigerant gas is then passed from the high-pressure chamber side through the discharge port and the discharge muffling chamber to flow into a radiator outside the compressor.

In the vertical type rotary compressor, a bottom part positioned below the compression mechanisms section in the airtight container is used as an oil reservoir. Oil is sucked from the oil reservoir by an oil pump disposed in a lower end of the rotary shaft, and supplied to the compression mechanism section, whereby abrasion of the compression mechanism section and a sliding part of the rotary shaft is prevented, and sealing is secured.

Among such rotary compressors, there is a type in which an airtight container is horizontally installed to reduce a height. In this case, a rotary shaft is extended in a horizontal direction, and first and second rotary compression elements are arranged side by side left and right.

In the cylinder which constitutes the second rotary compression element of the rotary compressor of the multistage compression system, pressure becomes higher than the intermediate pressure in the airtight container. The oil dissolved in the refrigerant sucked into the second rotary compression element is separated therefrom at a stage in which the refrigerant is discharged into the airtight container. Accordingly, oil supplying into the cylinder of the second rotary compression element becomes difficult, causing a problem of oil running-out.

If such a rotary compressor is used as a horizontal type, the oil supplied to the first rotary compression element is dissolved in the refrigerant gas compressed by the same, and the oil stays not only in the oil pump side but also in the bottom part of the airtight container of the driving element side. Consequently, there is a fear that oil suction by the oil pump constituted in the end of the compression mechanism section side of the rotary shaft may not be smooth.

Additionally, the oil mixed in the refrigerant gas compressed by the first rotary compression element is discharged into the airtight container, and separated from the refrigerant gas to a certain extent in a process of movement in a space of the airtight container. However, the oil mixed in the refrigerant gas compressed by the second rotary compression element is directly discharged with the refrigerant gas to the outside of the compressor.

Consequently, oil becomes short in the oil reservoir, and oil suction by the oil pump is not smoothly executed, causing a problem of reductions in sliding performance and sealing performance. Moreover, there is a fear that a refrigerant circuit may be adversely affected, e.g., interference with refrigerant circulation in the refrigerant circuit by the oil discharged to the outside of the compressor.

Furthermore, in order to prevent the oil discharging to the outside of the compressor, an oil separator is connected to a refrigerant discharge tube to separate oil from a discharged refrigerant gas, and to return it to the compressor. However, there is a problem of an expanded installation space, or the like.

SUMMARY OF THE INVENTION

The present invention has been made to solve the foregoing conventional technical problems, and designed to execute sure supplying of oil to a second rotary compression element in a horizontal type compressor that comprises the second rotary compression element in which pressure becomes higher than that in an airtight container.

That is, a horizontal type compressor of the present invention comprises a compression mechanism section constituted of first and second rotary compression elements, discharges a refrigerant compressed by the first rotary compression element into an airtight container, and further compresses the discharged refrigerant of intermediate pressure by the second rotary compression element to discharge the refrigerant. An oil supply passage is formed in a cylinder of the second rotary compression element to communicate a low-pressure chamber of the cylinder with a bottom part in the airtight container. Pressure is roughly equal to each other between the inside of the airtight container and the low-pressure chamber. Thus, oil stored in the bottom part in the airtight container can be drawn by a flow of a sucked refrigerant of the low-pressure chamber side to be supplied through the oil supply passage formed in the cylinder of the second rotary compression element to the low-pressure chamber thereof.

In addition to the above, the horizontal type compressor of the invention comprises a notch formed in a cylinder bottom part of the second rotary compression element, and the oil supply passage is opened in the notch. Thus, the oil stored in the bottom part in the airtight container can smoothly flow through the notch into the oil supply passage.

A horizontal type compressor of the present invention comprises a compression mechanism section constituted of first and second rotary compression elements, discharges a refrigerant compressed by the first rotary compression element into an airtight container, and further compresses the discharged refrigerant of intermediate pressure by the second rotary compression element to discharge the refrigerant. An oil supply passage is formed in an intermediate partition plate held between cylinders of the first and second rotary compression elements to communicate a low-pressure chamber of the cylinder of the second rotary compression element with a bottom part in the airtight container. Thus, oil stored in the bottom part in the airtight container can be supplied through the oil supply passage formed in the intermediate partition plate to the low-pressure chamber of the cylinder of the second rotary compression element.

In addition to the above, in the horizontal type compressor of the invention, the oil supply passage is opened in a slope of a suction port formed to be inclined in the cylinder of the second rotary compression element. Thus, an ejector effect can be exhibited by a flow of a refrigerant sucked by using an angle of the suction port.

Another object of the present invention is to provide a horizontal type rotary compressor which can reduce an amount of oil discharged to the outside, and smoothly supply oil to a rotary compression mechanism section or the like. Therefore, a horizontal type compressor of the invention is constituted by housing a driving element and a rotary compression mechanism section driven by the driving element in an airtight container, and comprises: oil supplying means for supplying oil from an oil reservoir of a bottom part in the airtight container to the rotary compression mechanism section or the like; oil separating means disposed in the airtight container to centrifugally separate oil from a refrigerant discharged from the rotary compression mechanism section; and an oil passage through which the oil separated by the oil separating means is returned to the oil reservoir. An outlet of the oil passage is directed to the oil supplying means side.

The horizontal type compressor of the invention further comprises: a baffle plate which divides the inside of the airtight container into the driving element side and the rotary compression mechanism section side to generate differential pressure; and a small-diameter passage positioned in the oil reservoir to communicate the driving element side of the baffle plate with the rotary compression mechanism section side thereof. The oil supplying means is disposed on the rotary compression mechanism section side of the baffle plate, the rotary compression mechanism section is constituted of first and second rotary compression elements, a refrigerant compressed by the first rotary compression element is discharged into the airtight container, and the refrigerant is sucked from the airtight container to be compressed by the second rotary compression element. The refrigerant compressed by the first rotary compression element is discharged to the driving element side of the baffle plate, and the outlet of the oil passage is directed from the driving element side of the baffle plate to the small-diameter passage.

Another object of the present invention is to assure separation of refrigerating machine oil in an airtight container, and to smoothly supply refrigerating machine oil into a cylinder of a second rotary compression element in the case of using an internal intermediate pressure type rotary compressor of a multistage compression system as a horizontal type. Thus, a horizontal type compressor of the invention comprises: an airtight container in a bottom part of which an oil reservoir is formed to store refrigerating machine oil; a rotary compression mechanism section which includes a first stage compression element and a second stage compression element sequentially arranged from one side of the airtight container, and which is arranged in the airtight container; a motor arranged on the other side of the second stage compression element in the airtight container to directly interconnect and drive the first and second stage compression elements; a baffle plate which divides the inside of the airtight container into a compressor chamber to house the rotary compression mechanism section and a motor chamber to house the motor in a state of penetrating an end of a bearing of the second stage compression element; a refrigerant passage which permits distribution of a refrigerant from the motor chamber to the compressor chamber; a refrigerating machine oil passage which permits distribution of refrigerating machine oil from the motor chamber to the compressor chamber; and a refrigerating machine oil collecting member made of a permeable material and disposed between the bearing and the motor partially in contact with an end surface of the bearing of the second stage compression element. The first stage compression element has an intermediate discharge pipe constituted to spray a discharged gas refrigerant toward the refrigerating machine oil collecting member in the motor chamber, and the second stage compression element has a suction passage formed to suck a gas refrigerant from the compressor chamber.

Yet another object of the present invention is to smoothly supply refrigerating machine oil to a sliding part even in use in which a compressor is run in an inclined or vibrated state in a so-called internal intermediate pressure type rotary compressor of a multistage compression system which is made a horizontal type. Thus, a horizontal type compressor of the invention comprises: an airtight container in a bottom part of which an oil reservoir is formed to store refrigerating machine oil; a rotary compression mechanism section which includes a first stage compression element and a second stage compression element; a motor arranged on a side of the rotary compression mechanism section to directly connect the rotary compression mechanism section with a rotary shaft to drive the same; a pump mechanism disposed in an end of the rotary compression mechanism section side of the rotary shaft; a refrigerating machine oil suction pipe connected to the pump mechanism to draw the refrigerating machine oil from the oil reservoir; a baffle plate arranged between the rotary compression mechanism section and the motor to divide the inside of the airtight container into a compressor chamber to house the rotary compression mechanism section and a motor chamber to house the motor; and an aperture formed between an outer peripheral end surface of the baffle plate and an inner peripheral surface of the airtight container. The first stage compression element is formed to discharge a discharged gas refrigerant into the motor chamber, the second stage compression element is formed to suck a gas refrigerant from the compressor chamber, and a tip opening of the refrigerating machine oil suction pipe is arranged near the baffle plate in the compressor chamber of the oil reservoir.

According to the invention, the baffle plate may comprise a refrigerating machine oil distribution hole through which the refrigerating machine oil is distributed to a lower part, and a check valve which blocks a reverse flow of the refrigerating machine oil from the compression chamber through the refrigerating machine oil distribution hole to the motor chamber.

A further object of the present invention is to smoothly supply refrigerating machine oil to a sliding part even in use in which a compressor is run in an inclined state in a so-called internal intermediate pressure type rotary compressor of a multistage compression system which is made a horizontal type. Thus, a horizontal type compressor of the invention comprises: an airtight container in a bottom part of which an oil reservoir is formed to store refrigerating machine oil; a rotary compression mechanism section which includes a first stage compression element and a second stage compression element; a motor arranged on a side of the rotary compression mechanism section to directly connect the rotary compression mechanism section with a rotary shaft to drive the same; a pump mechanism disposed in an end of the rotary compression mechanism section side of the rotary shaft; a refrigerating machine oil suction pipe connected to the pump mechanism to draw the refrigerating machine oil from the oil reservoir; and a baffle plate arranged between the rotary compression mechanism section and the motor to divide the inside of the airtight container into a compressor chamber to house the rotary compression mechanism section and a motor chamber to house the motor. The first stage compression element is formed to discharge a discharged gas refrigerant into the motor chamber, the second stage compression element is formed to suck a gas refrigerant from the compressor chamber, and the baffle plate includes a disk partition part to divide the airtight container, and a wall part extended from the partition part to the motor side and arranged by forming a small aperture from an inner surface of the airtight container.

An automobile air conditioner of the present invention comprises the aforementioned horizontal type compressor, and a carbon dioxide gas refrigerant is used.

BRIEF DESCRIPTION OF THE DRAWINGS

FIG. 13A showing an oil surface state when the horizontal type rotary compressor of the 2-stage compression system is horizontal, FIG. 13B showing an oil surface state when the same is inclined to a rotary compression mechanism section side, and FIG. 13C showing an oil surface state when the same is inclined to a motor side;

FIG. 16A showing an oil surface state when the horizontal type rotary compressor of the 2-stage compression system is horizontal, FIG. 16B showing an oil surface state when the same is inclined to a rotary compression mechanism section side, and FIG. 16C showing an oil surface state when the same is inclined to a motor side.

DETAILED DESCRIPTION OF THE PREFERRED EMBODIMENT

(1) First Embodiment

Figure 1:
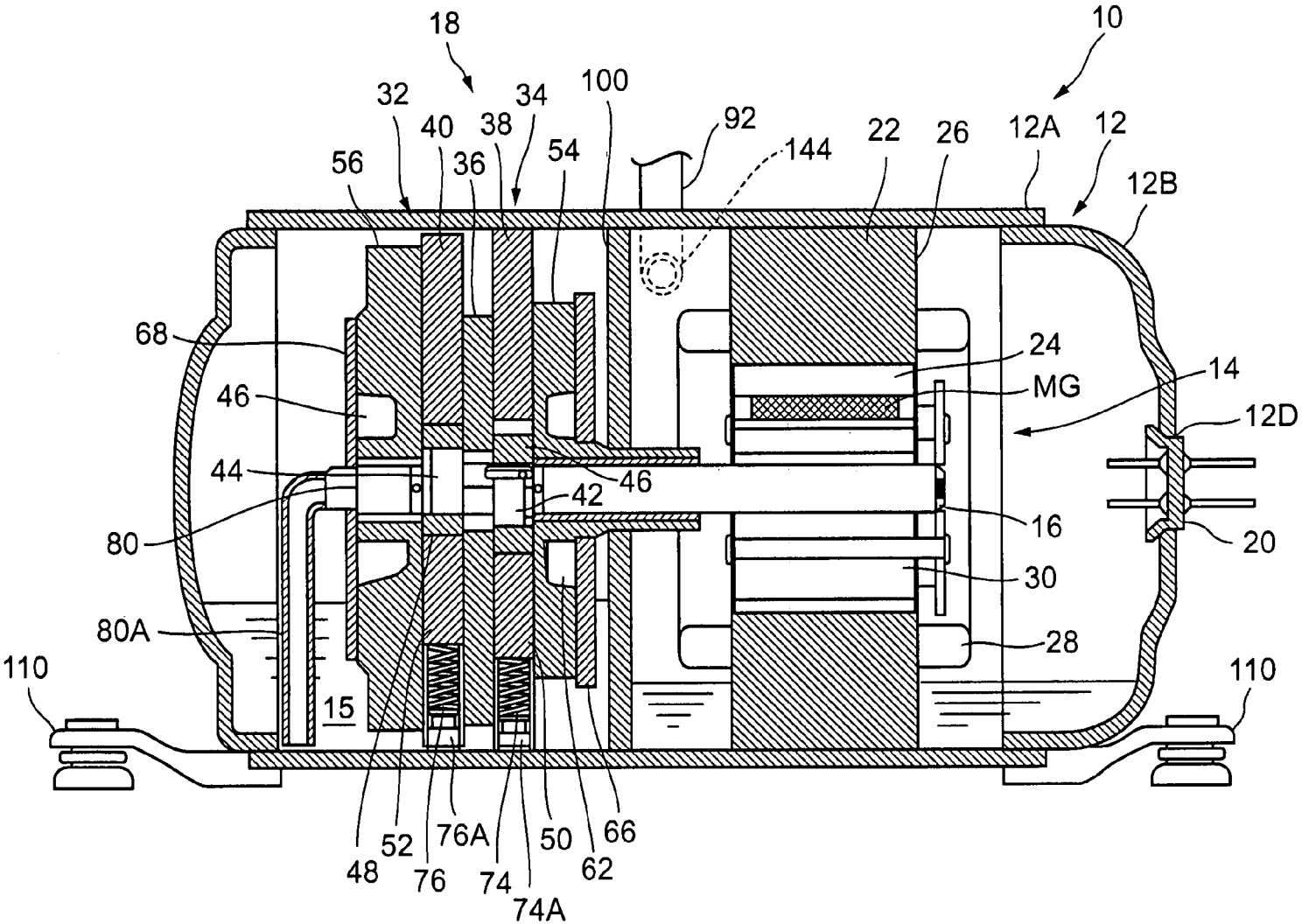
FIG. 1 is a vertical section front view (equivalent to a section cut along the line A-A of FIG. 2) of a horizontal type rotary compressor of an internal intermediate pressure type multistage compression system according to an embodiment of the present invention.
Figure 2:
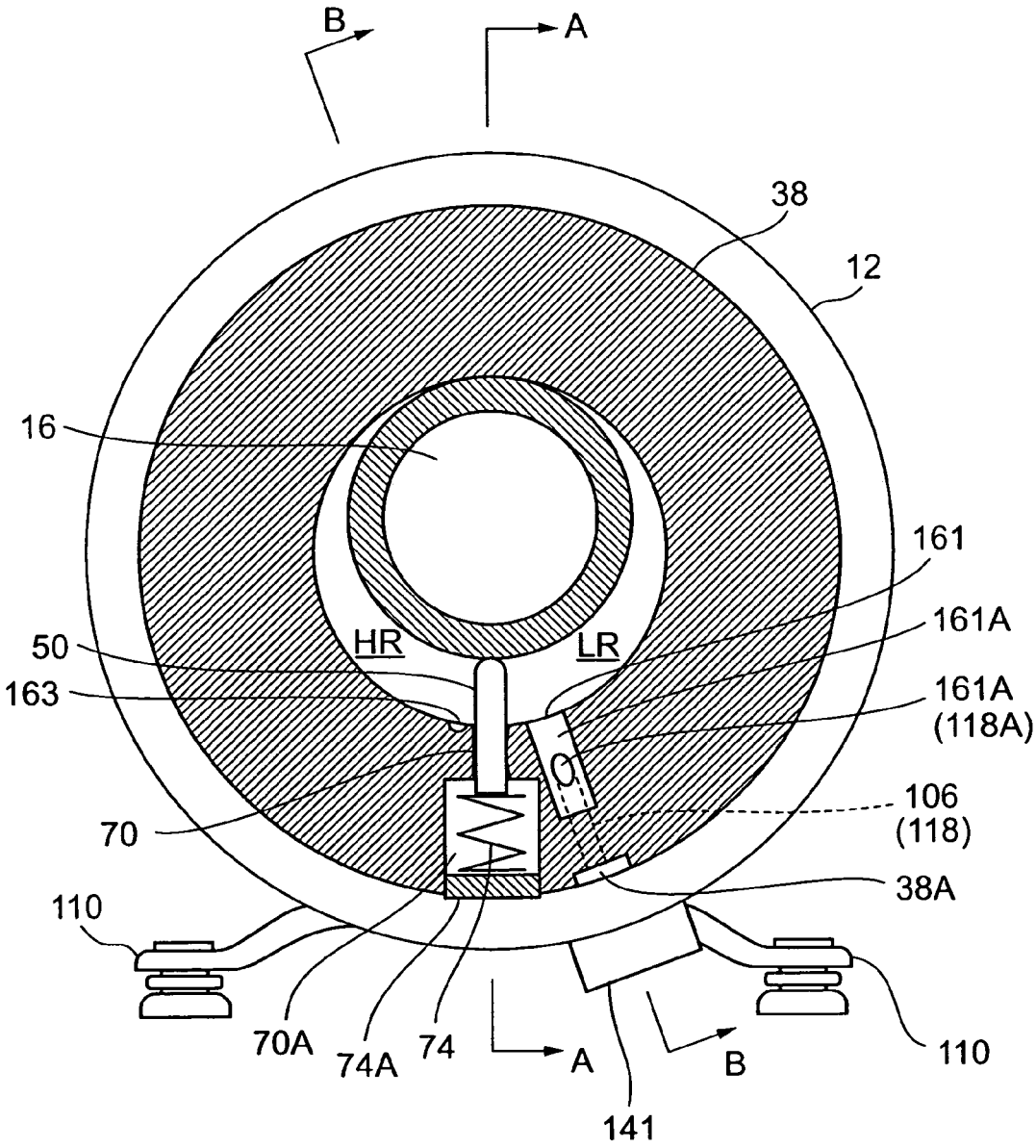
FIG. 2 is a vertical section side view of a second cylinder of the rotary compressor of the multistage compression system of FIG. 1.

Next, an embodiment of the present invention will be described in detail with reference to the accompanying drawings. FIG. 1 is a vertical section front view of a horizontal internal intermediate pressure type rotary compressor 10 of a multistage compression system (2 stages) which comprises first and second rotary compression elements 32, 34 as an embodiment of a horizontal type compressor of the invention. FIG. 2 is a vertical section side view of a second cylinder 38 of the rotary compressor 10 of the multistage compression system.

In the drawings, a reference numeral 10 denotes a horizontal internal intermediate pressure rotary compressor of a multistage compression system which uses carbon dioxide ($CO_2$) for a refrigerant. This rotary compressor 10 of the multistage compression system comprises a long-sideways and cylindrical horizontal type airtight container 12 both ends of which are sealed. A bottom part of the airtight container 12 is used as an oil reservoir 15. The airtight container 12 comprises a container main body 12A, and an end cap (cap body) 12B roughly bowl-shaped to close an opening thereof.

The airtight container 12 contains a driving element 14 constituted of an electric motor, and a compression mechanism section 18 constituted of first and second rotary compression elements 32 an 34 driven by a rotary shaft 16 of the horizontally extended driving element 14, which are disposed side by side left and right. A circular attaching hole 12D is formed in an end of the driving element 14 side of the airtight container 12, and a terminal 20 (wiring is omitted) is fixed to the attaching hole 12D to supply power to the driving element 14.

The driving element 14 comprises a stator 22 annularly attached along an inner peripheral surface of the airtight container 12, and a rotor 24 inserted and installed by setting a slight space inside the stator 22. The rotor 24 is fixed o a rotary shaft 16 extended through a center in an axial direction (horizontal direction) of the airtight container 12.

An oil pump 80 is disposed as oil supplying means in an end of the compression mechanism section 18 side of the rotary shaft 16. The oil pump 80 is disposed to draw up oil as lubricant oil from the oil reservoir 15 formed in a bottom part in the airtight container 12, and to supply the oil to the compression mechanism section 18 or a sliding part of the rotary shaft 16, thereby preventing abrasion and improving sealing performance. An oil suction pipe 80A is lowered from the oil pump 80 toward the bottom part of the airtight container 12, and opened in the oil reservoir 15.

The stator 22 has a laminated body 26 formed by staking doughnut-shaped electromagnetic steel plates, and a stator coil 28 wound on a tooth part of the laminated body 26 by a series winding (concentrated winding) method. The rotor 24 is constituted of an electromagnetic steel plate laminated body 30 as in the case of the stator 22, and a permanent magnet MG is inserted therein.

The first and second rotary compression elements 32 and 34 respectively comprise first and second cylinders 40, 38, and an intermediate partition plate 36 is held therebetween. That is, the compression mechanism section 18 comprises the first and second rotary compression elements 32 and 34, the intermediate partition plate 36, and the like. Outer peripheries of the cylinders 40, 38 are in contact with or brought close to the inner surface of the airtight container 12.

That is, the first and second rotary compression elements 32, 34 respectively comprise the first and second cylinders 40, 38 arranged on both sides (left and right in FIG. 1) of the intermediate partition plate 36, first and second rollers 48, 46 fitted to first and second eccentric parts 44, 42 disposed in the rotary shaft 16 with a phase difference of 180° to be eccentrically rotated in the first and second cylinders 40, 38, first and second vanes 52, 50 respectively abutted on the rollers 48, 46 and reciprocated to divide the insides of the cylinders 40, 38 into low-pressure chamber LR sides and high-pressure chamber HR sides (FIG. 2), and supporting members 54, 56 which close an opening surface of the driving element 14 side of the cylinder 38 and an opening surface of an opposite side of the driving element 14 of the cylinder 40 to serve also as bearings of the rotary shaft 16.

Both cylinders 40, 38 include guiding grooves 70 disposed to house the first and second vanes 52, 50 so that they can freely slide. Springs 76, 74 are disposed outside the guiding grooves 70, and abutted on outer ends of the first and second vanes 52, 50 to always press the same to the roller 48, 46 sides. Further, metal plugs 76A, 74A are disposed on the airtight container 12 side of the springs 76, 74 to prevent pulling-out thereof. A back pressure chamber 70A is disposed in the second vane 50, and pressure of the high-pressure chamber HR side of the cylinder 38 is applied as back pressure to the back pressure chamber 70A.

According to the rotary compressor 10 of the multistage compression system of the embodiment, the vanes 52, 50 are constituted to be positioned in lowermost parts of the cylinders 40, 38 and to move up and down (FIG. 2). Suction ports 162, 161 communicated with the low-pressure chambers LR in the cylinders 40, 38 are formed adjacently to the vanes 52, 50 as shown in FIG. 2. Especially, as shown in FIG. 3, the suction ports 162, 161 are formed to be inclined so that the supporting members 56, 54 sides can be low while the intermediate partition plate 36 side can be high, thereby forming slopes 162A, 161A.

The supporting members 54, 56 include suction passages 58, 60 communicated through the suction ports 161, 162 with the low-pressure chamber sides LR in the cylinders 38, 40, and discharge muffling chambers 62, 64 formed by partially recessing the members 54, 56 and closing the recessed parts with covers 66, 68. In FIG. 3, a reference numeral 163 denotes a discharge port formed by being communicated with the high-pressure chamber HR in the cylinder 38 (cylinder 40 side is not shown).

Figure 3:
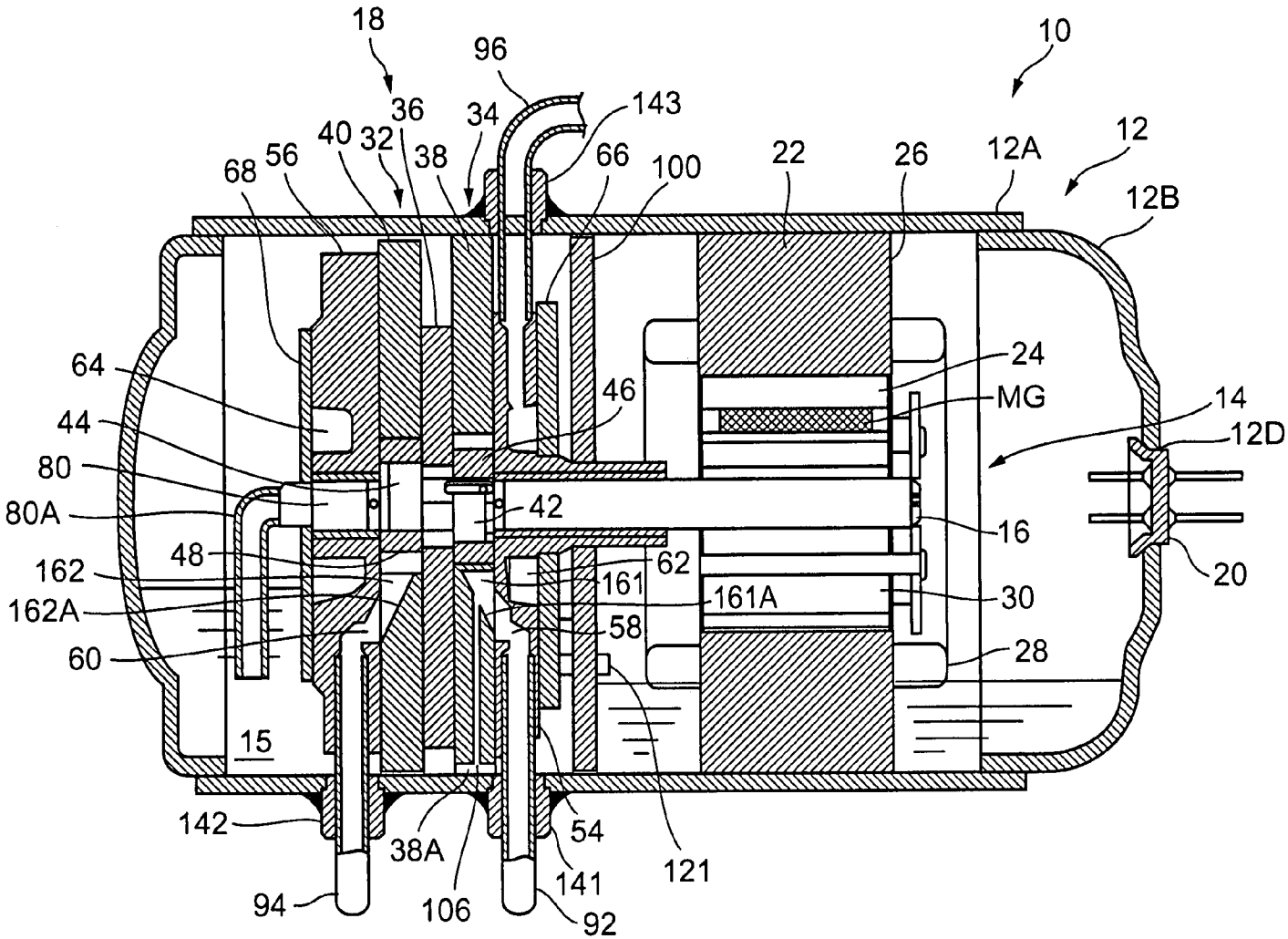
FIG. 3 is a sectional view cut along the line B-B of FIG. 2 of the rotary compressor of the multistage compression system of the invention.

A bottom part of a position corresponding to an extension line of the suction port 161 of the cylinder 38 of the second rotary compression element 34 is notched inward over the intermediate partition plate 36 side and the supporting member 54 side, whereby a notch 38A is formed therein to be recessed by a predetermined size toward the rotary shaft 16 (FIGS. 2 and 3). The notch 38A is positioned in the oil reservoir 15 in the bottom part of the airtight container 12. Then, in the cylinder 38, an oil supply passage 106 is formed between the notch 38A and the suction port 161.

An upper end of the oil supply passage 106 is opened in the slope 161A of the suction port 161 formed to be inclined in the cylinder 38, while a lower end thereof is opened in the notch 38A. That is, the oil supply passage 106 has an oblique opening 106A in the slope 161A, and communicates the low-pressure chamber LR side of the cylinder 38 with the oil reservoir 15 in the bottom part of the airtight container 12.

The discharge muffling chamber 64 is communicated with the inside of the airtight container 12 by a communication path (not shown) which penetrates the cylinders 40, 38, the intermediate partition plate 36, the cover 66, and a baffle plate 100 (described later) disposed apart from the cover 66 to be opened in the driving element 14 side. An intermediate discharge pipe 121 is disposed to project in an end of the communication path. A refrigerant gas of intermediate pressure compressed by the first rotary compression element 32 is discharged from the intermediate discharge pipe 121 to the driving element 14 side in the airtight container 12. At this time, oil supplied to the first rotary compression element 32 is mixed in the refrigerant gas, and this oil is also discharged to the driving element 14 side in the airtight container 12. The oil mixed in the refrigerant gas is then separated therefrom to be stored in the oil reservoir 15 in the bottom part of the airtight container 12.

The baffle plate 100 is disposed to divide the inside of the airtight container 12 into the driving element 14 side and the compression mechanism section 18 side so that differential pressure can be generated therein. The baffle plate 100 is constituted of a doughnut-shaped steel plate arranged by leaving a slight space from the inner surface of the airtight container 12. In this case, a refrigerant gas of intermediate pressure compressed by the first rotary compression element 32 and discharged to the driving element 14 side in the airtight container 12 flows through the space formed between the airtight container 12 and the baffle plate 100 into the compression mechanism section 18 side. By the presence of the baffle plate 100, differential pressure is generated in the airtight container 12 in which pressure of the driving element 14 side of the baffle plate 100 is high while pressure of the compression mechanism section 18 side is low.

The differential pressure causes the oil stored in the oil reservoir 15 in the bottom part of the airtight container 12 to move to the compression mechanism section 18 side, whereby an oil level thereof is increased more than that of the baffle plate 100. In this case, an upper surface of the oil stored in the oil reservoir 15 in the bottom part of the airtight container 12 reaches at least a part above a lower end of the oil suction pipe 80A and a lower end opening (notch 38A) of the oil supply passage 106.

An angle between the opening 106A of the oil supply passage 106 opened in the slope 161A of the suction port 161 and the slope 161A of the same (angle of intake air flowing direction of the refrigerant of the second rotary compression element 34) is set to easily exhibit an ejector function. Accordingly, the ejector function is exhibited in the opening 106A by a refrigerant gas sucked through the suction port 161 to the low-pressure chamber LR side of the cylinder 38 to set low pressure in the oil supply passage 106.

Thus, the oil reserved in the oil reservoir 15 in the bottom part of the airtight container 12 is drawn up through the oil supply passage 106 to be sucked from the opening 106A to the low-pressure chamber LR side of the cylinder 38. On the other hand, since the opening of the oil suction pipe 80A is dipped in the oil, supplying of oil to the sliding part of the compression mechanism section 18 by the oil pump 80 is smoothly carried out.

As the refrigerant in this case, the carbon dioxide ($CO_2$) which is a natural refrigerant is used in consideration of friendliness to a global environment, combustibility, toxicity and the like. As the oil as a lubricant oil to be sealed in the airtight container 12, for example, existing oil such as mineral oil, alkylbenzene oil, ether oil, ester oil, or polyalkyl glycol (PAG) is used.

On a side face of the airtight container 12, sleeves 141, 142, and 143 are welded to be fixed to the supporting member 56 and positions corresponding to sides thereof. One end of the refrigerant introduction pipe 94 is inserted and connected in the sleeve 142 to introduce a refrigerant to the cylinder 40, and communicated with a suction passage 60. One end of a refrigerant introduction pipe 92 is inserted and connected in the sleeve 141 to supply a refrigerant gas into the cylinder 38, and communicated with a suction passage 58 of the cylinder 38.

The refrigerant introduction pipe 92 is passed through an upper side other than the airtight container 12 to reach the sleeve 144. The other end thereof is inserted and connected in the sleeve 144 to be communicated with an upper part in the airtight container 12 of the driving element 14 side (between the driving element 14 and the baffle plate 100) of the baffle plate 100. Additionally, a refrigerant discharge pipe 96 is inserted into the sleeve 143, and one end thereof is communicated with the discharge muffling chamber 62. Further, an attaching pedestal 110 is disposed in the bottom part of the airtight container 12 (FIG. 1).

Next, an operation of the foregoing constitution will be described. When the stator coil 28 of the driving element 14 is energized through a terminal 20 and a wiring (not shown), the driving element 14 is started to rotate the rotor 24. This rotation is accompanied by eccentric rotation of the rollers 48, 46 fitted to the first and second eccentric parts 44, 42 integrally disposed with the rotary shaft 16 in the cylinders 40, 38.

Accordingly, a refrigerant (low pressure) passed through the refrigerant introduction pipe 94 and the suction passage 60 formed in the supporting member 56 and sucked from the suction port 162 to the low-pressure chamber LR side of the cylinder 40 of the first compression element 32 is compressed by operating the roller 48 and the vane 52 to become intermediate pressure, and discharged from the high-pressure chamber HR side of the cylinder 40 to the discharge muffling chamber 64. The refrigerant is passed therefrom through the communication path to be discharged from the intermediate discharge pipe 121 into the airtight container 12. Thus, intermediate pressure is set in the airtight container 12, oil mixed in the refrigerant gas is stuck to the inner surface of the airtight container 12, and passed through the inner surface thereof to return to the oil reservoir 15 in the bottom part.

Then, the refrigerant gas of the intermediate pressure flows from the airtight container 12 through the refrigerant introduction pipe 92. It is passed through the upper side other than the airtight container 12, and sucked from the suction passage 58 through the suction port 161 to the low-pressure chamber LR side of the cylinder 38 of the second rotary compression element 34. At this time, since an angle between the slope 161A of the suction port 161 and the opening 106A exhibits an ejector function in the process of sucking the refrigerant from the suction port 161, the oil stored in the oil reservoir 15 in the bottom part of the airtight container 12 is drawn up through the oil supply passage 106, and sucked from the opening 106A to the low-pressure chamber LR side of the cylinder 38. Thus, the oil can be supplied to the sliding part of the second rotary compression element 34 quite surely. Since the oil supply passage 106 is opened apart from the inner surface of the airtight container 12 in the notch 38A formed in the cylinder 38, the oil of the oil reservoir 15 can smoothly flow in.

The refrigerant gas of the intermediate pressure sucked to the low-pressure chamber LR side of the cylinder 38 is subjected to compression of a second stage by operating the roller 46 and the vane 50 to become a high-temperature and high-pressure refrigerant gas. The high-temperature and high-pressure refrigerant gas is passed from the high-pressure chamber HR side through the discharge port 163, and through the discharge muffling chamber 62 formed in the supporting member 54 to flow from the refrigerant discharge pipe 96 into a gas cooler (radiator, not shown) or the like. After heat radiation at the gas cooler, pressure of the refrigerant is reduced by the pressure reduction device or the like (not shown), and the refrigerant flows into an evaporator (not shown).

The refrigerant is evaporated, and then a cycle of passage through an accumulator and suction from the refrigerant introduction pipe 94 into the first rotary compression element 32 is repeated.

Thus, the oil stored in the oil reservoir 15 in the bottom part of the airtight container 12 can be directly sucked through the oil supply passage 106 to the suction port 161. As a result, it is possible to secure lubrication and sealing in the cylinder 38 of the second rotary compression element 34 in which pressure becomes higher than that in the airtight container 12.

Figure 4:
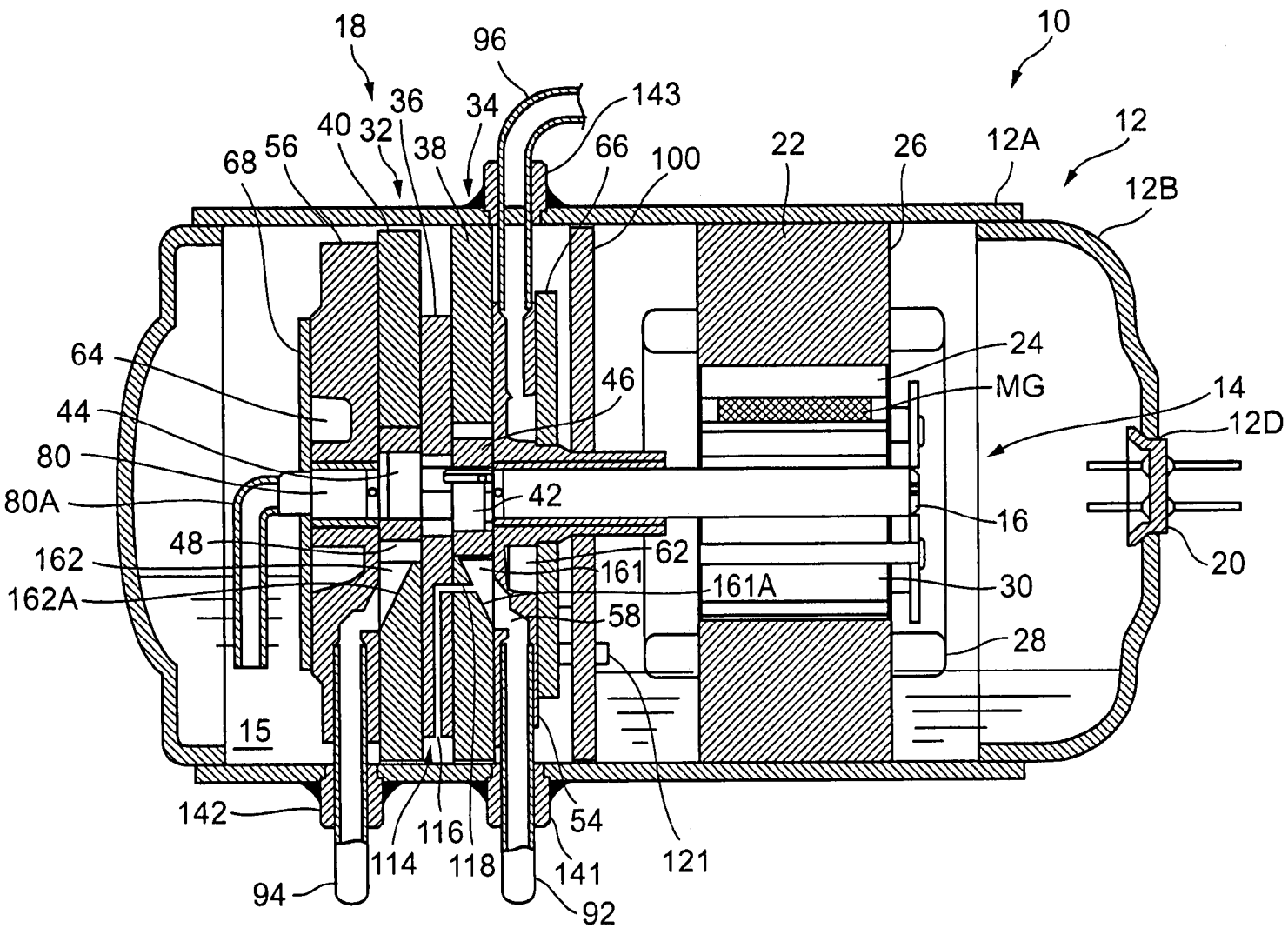
FIG. 4 is a sectional view cut along the line B-B of FIG. 2 of a rotary compressor of a multistage compression system according to another embodiment.

FIG. 4 shows a rotary compressor 10 of a multistage compression system as a horizontal type compressor according to another embodiment of the present invention. In the drawing, reference numerals similar to those of FIGS. 1 to 3 have identical or similar functions. In this case, an oil supply passage 114 is formed between a suction port 161 disposed in a cylinder 38 and an oil reservoir 15 in a bottom part of an airtight container 12. This oil supply passage 114 comprises a vertical passage 116 formed in an intermediate partition plate 36 and a horizontal passage 118 formed in a second cylinder 38.

One end of the horizontal passage 118 formed in the second cylinder 38 is positioned in a slope 161A of the suction port 161 to be opened as in the previous case, while the other end is extended to the intermediate partition plate 36. A lower end of the vertical passage 116 formed in the intermediate partition plate 36 is opened in the bottom part in the airtight container 12, while an upper end is extended to a height of the horizontal passage 118 formed in the second cylinder 38, and bent there to be communicated with the other end of the horizontal passage 118. That is, the oil supply passage 114 is passed from the suction port 161 through the horizontal passage 118 and the vertical passage 116 to be opened in the oil reservoir 15 in the bottom part of the airtight container 12. In the oil supply passage 114, an oblique opening in the suction port 161 is set as an opening 118A. Others are constituted as in the previous case.

Thus, oil can be smoothly supplied into the cylinder 38 of the second rotary compression element 34 of the second stage as in the previous case. Especially, in this case, most of the oil supply passage 114 (vertical passage 116) is formed in the intermediate partition plate 36. Thus, compared with the case of forming all in the cylinder 38, processing is facilitated to reduce production costs.

As described above, according to the present invention, since the oil supply passage is formed in the cylinder of the second rotary compression element to communicate the low-pressure chamber thereof with the bottom part in the airtight container, the oil stored in the bottom part of the airtight container can be supplied through the oil supply passage formed in the cylinder of the second rotary compression element to the low-pressure chamber of the cylinder. Accordingly, oil can be surely supplied into the cylinder of the second rotary compression element in which pressure becomes higher than that in the airtight container to secure lubrication and sealing of the sliding part.

Since the oil supply passage is formed in the intermediate partition plate between the cylinders of the first and second rotary compression elements to communicate the low-pressure chamber of the cylinder of the second rotary compression element with the bottom part in the airtight container, the oil stored in the bottom part of the airtight container can be supplied through the oil supply passage formed in the intermediate partition plate to the low-pressure chamber of the cylinder of the second rotary compression element. Accordingly, oil can be surely supplied into the cylinder of the second rotary compression element in which pressure becomes higher than that in the airtight container to secure lubrication and sealing of the sliding part. Especially, in this case, since processing becomes relatively easy, it is possible to suppress an increase in production costs.

Furthermore, the oil stored in the bottom part of the airtight container can be smoothly drawn up through the oil supply passage. Thus, it is possible to further improve performance of oil supplying into the cylinder of the second rotary compression element.

(2) Second Embodiment

Figure 5:
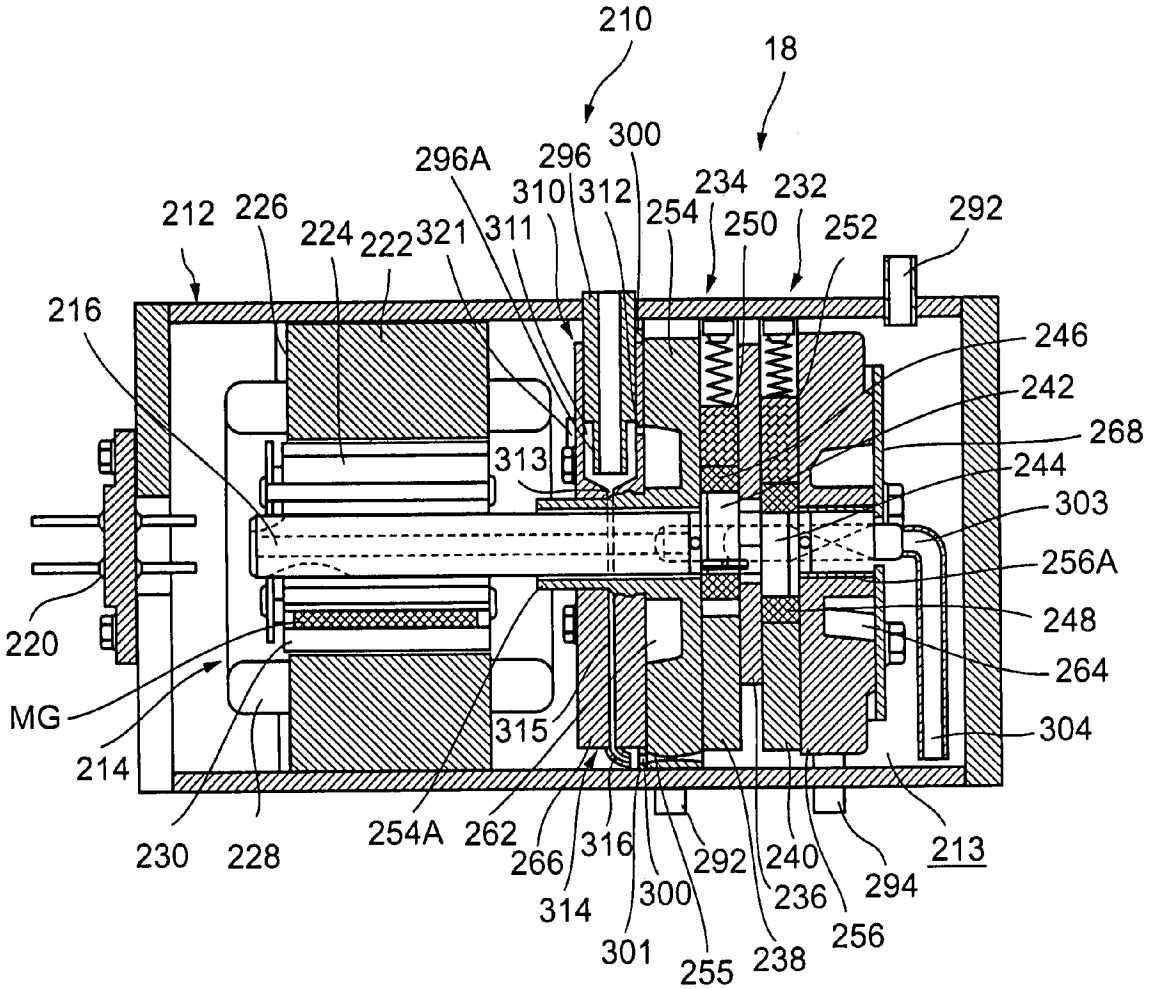
FIG. 5 is a vertical sectional view of a horizontal type rotary compressor according to yet another embodiment of the present invention.

Next, FIG. 5 is a vertical sectional view of an internal intermediate pressure type rotary compressor 10 of a multistage compression system (2 stages) which comprises first and second rotary compression elements 32, 34 as an embodiment of a horizontal type compressor of the invention.

In FIG. 5, a reference numeral 210 denotes a horizontal internal intermediate pressure rotary compressor of a multistage compression system which uses carbon dioxide ($CO_2$) for a refrigerant. This rotary compressor 210 comprises a cylindrical horizontal type airtight container 212 made of a steel plate, and a rotary compression mechanism section 218 constituted of a driving element 214 which is an electric element arranged and housed in an internal space of the airtight container 212, and first and second rotary compression elements 232 an 234 (first and second stages) driven by a rotary shaft 216 of the driving element 214.

A bottom part of the airtight container 212 is used as an oil reservoir 213. The airtight container 212 comprises a container main body 212A to house the rotary compression mechanism section 218, and an end cap (cap body) 212B roughly bowl-shaped to close an opening thereof. A terminal 220 (wiring is omitted) is fixed to a center of the end cap 212B to supply power to the driving element 214.

The driving element 214 comprises a stator 222 annularly attached along an inner peripheral surface of the airtight container 212, and a rotor 224 inserted and installed by setting a slight space inside the stator 222. The rotor 224 is fixed to the rotary shaft 216 extended through a center in an axial direction (horizontal direction) of the airtight container 212.

The stator 222 has a laminated body 226 formed by staking doughnut-shaped electromagnetic steel plates, and a stator coil 228 wound on a tooth part of the laminated body 226 by a series winding (concentrated winding) method. The rotor 224 is constituted of an electromagnetic steel plate laminated body 230 as in the case of the stator 222, and a permanent magnet MG is inserted therein.

An oil pump 303 is disposed as oil supplying means on a side of the first and second rotary compression elements 232, 234 opposite the driving element 214, i.e., in an end of the rotary compression mechanism section 218 side of the rotary shaft 16. The oil pump 303 is disposed to draw up oil as lubricant oil from the oil reservoir 213 formed in a bottom part in the airtight container 212, and to supply the oil to a sliding part of the rotary compression mechanism section 218, thereby preventing abrasion. An oil suction pipe 304 is lowered from the oil pump 303 toward the bottom part of the airtight container 212, and opened in the oil reservoir 213.

The first and second rotary compression elements 232 and 234 respectively comprise cylinders 238, 240 arranged on both sides (left and right in FIG. 5) of an intermediate partition plate 236, rollers 246, 248 fitted to eccentric parts 242, 244 disposed in the rotary shaft 16 with a phase difference of 180° to be eccentrically rotated in the cylinders 238, 240, vanes 250, 252 respectively abutted on the rollers 246, 248 to divide the insides of the cylinders 238, 240 into low-pressure chamber sides and high-pressure chamber sides, and supporting members 254, 256 which close an opening surface of the driving element 214 side of the cylinder 238 and an opening surface of an opposite side (oil pump 303 side) of the driving element 214 of the cylinder 240 to serve also as bearings of the rotary shaft 216.

The supporting members 254 and 256 include suction passages (not shown) communicated through suction ports (not shown) with insides of the cylinders 238, 240, and discharge muffling chambers 262, 264 formed by partially recessing the members 254, 256 and closing the recessed parts with covers 266, 268. Bearings 254A, 256A are formed in centers of the supporting members 254 and 256 to support the rotary shaft 216.

A baffle plate 300 is formed in an outer peripheral surface of the cover 266. This baffle plate 300 is constituted of a doughnut-shaped steel plate, and fixed by welding a connection part with the cover 266. The baffle plate 300 is close to an inner surface of the airtight container 212 roughly on a full circumference, and a space is formed therebetween to pass a refrigerant gas between the driving element 214 side and the rotary compression mechanism section 218 side.

A refrigerant gas of intermediate pressure compressed by the first rotary compression element 232 and discharged to the driving element 214 side in the airtight container 212 flows through the space formed between an outer peripheral edge of the baffle plate 300 and the inner peripheral surface of the airtight container 12 into the rotary compression mechanism section 218 side. By the presence of the baffle plate 300, differential pressure is generated in the airtight container 212 in which pressure of the driving element 214 side of the baffle plate 300 is high while pressure of the rotary compression mechanism section 18 side is low.

Figure 6:
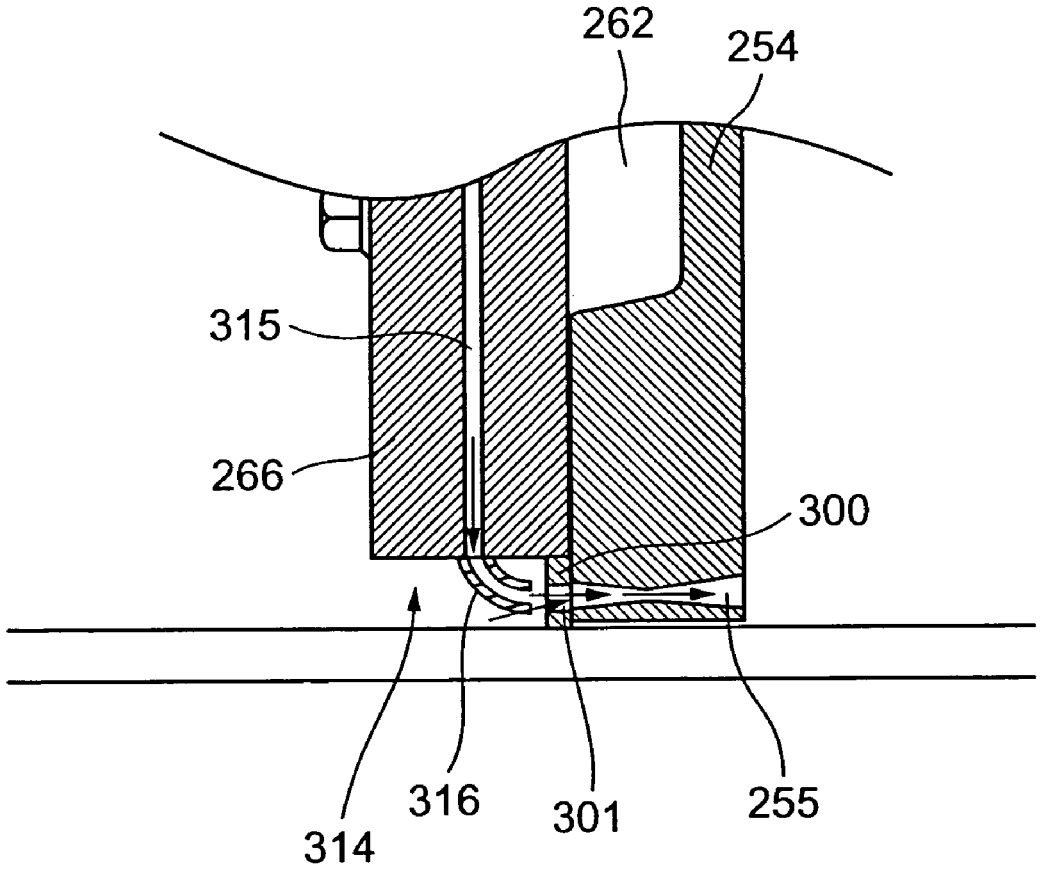
FIG. 6 is a view showing a flow of oil in an oil reservoir of a driving element side of a baffle plate of FIG. 5.

A small hole 301 is formed in a lower part in the baffle plate 300 as shown in FIG. 6. This small hole 301 is positioned in the oil reservoir 213 in the airtight container 212, and penetrates the baffle plate 300 in an axial direction (horizontal direction). As it is dipped in the oil in the oil reservoir 213, the small hole 301 has no influence on the differential pressure.

A small-diameter passage 255 is formed in the supporting member 254 adjacent to the small hole 301 of the baffle plate 300 to penetrate the same in an axial direction (horizontal direction). This small-diameter passage 255 communicates the driving element 214 side of the baffle plate 300 with the rotary compression mechanism section 218 side, and it is formed in a position roughly corresponding to the small hole 301 formed in the baffle plate 300 adjacent to the driving element 214 side of the supporting member 254.

The baffle plate 300 side (driving element 214 side) of the small-diameter passage 255 has a diameter roughly equal to that of the small hole 301, and a shape in which the diameter is made gradually thinner therefrom toward the rotary compression mechanism section 218 side, becomes smallest near the rough center of the small-diameter passage 255, and made gradually thicker therefrom toward the rotary compression mechanism section 218 side. Incidentally, the small-diameter passage 255 is positioned in the oil reservoir 213 in the airtight container 212 as in the case of the small hole 301 of the baffle plate 300, and dipped in the oil therein. Thus, the small-diameter passage 255 has no influence on differential pressure generated by the baffle plate 300.

The cover 266 is constituted of a steel plate, and formed into a rough doughnut shape in which a hole is formed in a center to pass the rotary shaft 216 and the bearing 254A of the supporting member 254 through. Since intermediate pressure is set in the airtight container 212, the cover 266 is formed thick to prevent a problem of leakage of a high-temperature and high-pressure refrigerant discharged to the discharge muffling chamber 262 into the airtight container 212, whereby strength thereof is increased. Especially, in the case of using carbon dioxide for a refrigerant as in the case of the embodiment, since a pressure difference between the inside of the airtight container 212 and the discharge muffling chamber 262 becomes larger, the problem of leakage of the high-temperature and high-pressure refrigerant into the airtight container 212 is prevented by providing certain rigidity (thickness) to the cover 266.

In an upper part in the cover 266 formed thick, an oil separation mechanism 310 is disposed as oil separating means to centrifugally separate oil from a refrigerant compressed by the second rotary compression element 234 and discharged. The oil separating mechanism 310 is formed in the cover 266 positioned above the rotary shaft 216, and comprises a space part 311 which is formed into a vertically long cylindrical shape in the cover 266 and whose upper surface is opened, a communication hole 312 which communicates the space part 311 with the discharge muffling chamber 262, and an opening 313 formed below the space part 311.

Then, a refrigerant discharge pipe 296 formed to a size roughly equal to an inner diameter of the space part 311 is inserted from an opening of an upper surface of the space part 311, and a connection place is welded, thereby forming the oil separation mechanism 310. A tip 296A of the refrigerant discharge pipe 296 has a predetermined length, a pipe thickness is smaller than those of other parts, and the tip 296A is opened downward. An aperture is formed between the space part 311 and the tip 296A of the refrigerant discharge pipe 296. The communication hole 312 is positioned in the supporting member 254 roughly corresponding to an upper end of the tip 296A, and formed to discharge a refrigerant from the discharge muffling chamber 162 to an outer wall surface of the tip 296A of the refrigerant discharge pipe 296.

A lower side of the space part 311 has a roughly conical shape which is gradually made thinner toward the opening 313. Below the opening 313 of the oil separation mechanism 310, an oil hole 315 of an oil passage 314 which has a diameter roughly equal to that of the opening 313 is formed. The oil passage 314 returns the oil separated by the oil separation mechanism 310 to the oil reservoir 213 formed in the lower part in the airtight container 212, and comprises the oil hole 315 formed in the cover 266, and a communication pipe 316.

The oil hole 315 is communicated through the opening 313 with the oil separation mechanism 310 as described above, and opened in a bottom surface of the cover 266. The communication pipe 316 is connected to the opening of the bottom surface, and attached by fixing its connection with the cover 66 by welding or the like. An outlet of the communication pipe 316 of the oil passage 314 is opened in the oil reservoir 213 in the bottom part of the airtight container 212, and directed to the oil pump 303 side.

That is, according to the embodiment, the outlet of the communication pipe 316 of the oil passage 314 is directed from the driving element 214 side of the baffle plate 300 to the small-diameter passage 255, and constituted so that oil from the oil passage 314 can be easily moved through the small-diameter passage 255 to the rotary compression mechanism section 218 side (oil pump 303 side) of the baffle plate 300.

The discharge muffling chamber 264 of the first rotary compression element 232 is communicated through the communication path with the inside of the airtight container 212. This communication path is a hole which penetrates the supporting members 256, 254, the cover 266, the cylinders 238, 240, and the intermediate partition plate 236. In this case, an intermediate discharge pipe 321 is formed in an end of the communication path, and a refrigerant of intermediate pressure is discharged from the intermediate discharge pipe 321 to the driving element 214 side of the baffle plate 300 in the airtight container 212.

Incidentally, for oil as lubricant oil sealed in the airtight container 212, for example, existing oil such as mineral oil, alkylbenzene oil, ether oil, ester oil, or polyalkyl glycol (PAG) is used. For a refrigerant, the aforementioned carbon dioxide ($CO_2$) which is a natural refrigerant is used in consideration of friendliness to a global environment, combustibility, toxicity and the like.

The refrigerant introduction pipes 292, 294, and the refrigerant discharge pipe 296 are inserted through sleeves (not shown) to be connected to positions corresponding to those below the supporting member 254 of the side face of the airtight container 212, above a side opposite the driving element 214 of the rotary compression mechanism section 218 (position roughly corresponding to that above the oil pump 303), below the supporting member 256, and in an upper part of the cover 266.

Next, an operation of the rotary compressor 210 of the foregoing constitution will be described. When the stator coil 228 of the driving element 214 is energized through a terminal 220 and a wiring (not shown), the driving element 214 is started to rotate the rotor 224. This rotation is accompanied by eccentric rotation of the rollers 246, 248 fitted to the eccentric parts 242, 244 integrally disposed with the rotary shaft 216 in the cylinders 238, 240.

Accordingly, a refrigerant gas passed from the refrigerant introduction pipe 294 through a suction passage (not shown)

and a suction port, and sucked into the low-pressure chamber side of the cylinder 240 of the first rotary compression element 232 is compressed by operating the roller 248 and the vane 252 to become intermediate pressure, and discharged from the high-pressure chamber side of the cylinder 240 to the discharge muffling chamber 264. The refrigerant is then passed through the communication path to be discharged from the intermediate discharge pipe 321 to the driving element 214 side of the baffle plate in the airtight container 212. Thus, intermediate pressure is set in the airtight container 212.

The refrigerant gas of the intermediate pressure discharged to the driving element 214 side of the baffle plate 300 in the airtight container 212 is passed through the aperture formed between the outer peripheral edge of the baffle plate 300 and the inner peripheral surface of the airtight container 212 to flow into the rotary compression mechanism section 218 side of the baffle plate 300.

At this time, the passage of the refrigerant gas through the aperture formed between the outer peripheral edge of the baffle plate 300 in the airtight container 212 and the inner peripheral surface of the airtight container 212 has an effect of generating differential pressure in which pressure is high on the driving element 214 side of the baffle plate 300 while pressure is low on the rotary compression mechanism section 218 side of the same. The differential pressure facilitates flowing of oil from the airtight container 212 into the rotary compression mechanism section 218 side of the baffle plate 300.

Further, the refrigerant gas of the intermediate pressure that has flowed into the rotary compression mechanism section 218 side is passed through the refrigerant introduction pipe 292 connected to an upper side of the oil pump 303 of the side face of the airtight container 212, and sucked through the suction passage and the suction port (not shown) formed in the supporting member 254 to the low-pressure chamber side of the cylinder 238.

Then, the refrigerant gas is subjected to compression of a second stage by operating the roller 246 and the vane 250 to become a high-temperature and high-pressure refrigerant gas. The high-temperature and high-pressure refrigerant gas is passed from the high-pressure chamber side through a discharge port (not shown), discharged to the discharge muffling chamber 262 formed in the supporting member 254, and discharged from the communication hole 312 of the oil separation mechanism 310 into the space part 311. At this time, the refrigerant gas and oil mixed therein are discharged from the communication hole 312 to an outer wall surface of the tip 296A of the refrigerant discharge pipe 296 in the space part 311. The discharged refrigerant gas and oil are helically circulated through the aperture formed between the outer wall surface of the tip 296A and the inner peripheral surface of the space part 311 by a force of the discharging to be lowered in the space part 311.

In the process, the oil mixed in the refrigerant gas is centrifugally separated therefrom to be stuck to the outer peripheral surface or the like of the space part 311, and passed through the outer wall surface to flow from the opening 313 formed in the lower side of the space part 311 into the oil hole 315 of the oil passage 314. At this time, since pressure is high in the oil separation mechanism 310 and pressure is intermediate in the airtight container 212, the separated oil is extruded from the communication pipe 316 by the high-pressure refrigerant gas in the oil separation mechanism 310.

Since the communication pipe 316 is directed to the small-diameter passage 255 as described above, the extruded oil is passed through the small hole 301 as indicated by an arrow in FIG. 6 to move to the rotary compression mechanism section 218 side.

At this time, as the oil from the oil passage 314 is passed through the small-diameter passage 255 by using a speed of extrusion by the high-pressure refrigerant gas in the oil separation mechanism 310, the oil is accelerated in the process of passage through the small-diameter passage 255. Thus, even the oil in the oil reservoir 213 of the driving element 214 side of the baffle plate 300 is also sucked from the small hole 301 into the small-diameter passage 255. That is, the small-diameter passage 255 functions as an ejector pump to move the oil of the oil reservoir 213 of the driving element 214 side of the baffle plate 300 to the rotary compression mechanism section 218 side of the same (arrow in FIG. 6).

Thus, since the oil of the driving element 214 side of the baffle plate 300 is moved to the rotary compression mechanism section 218 side by the ejector effect of the small-diameter passage 255 in addition to the effect of the differential pressure by the baffle plate 300, an oil level in the oil reservoir 213 of the rotary compression mechanism section 218 side is increased. As a result, since the opening of the oil suction pipe 304 is dipped in the oil without any interference, the oil is smoothly supplied to the sliding part of the rotary compression mechanism section 218 by the oil pump 303.

On the other hand, the refrigerant gas flows into the refrigerant discharge pipe 296 from the refrigerant discharge pipe 296 opened in the lower part of the space part 311, and is discharged to the outside of the compressor 210.

Thus, by discharging the refrigerant gas compressed by the second rotary compression element 234 to the oil separation mechanism 310, the oil mixed in the refrigerant gas can be effectively separated centrifugally to greatly reduce an amount of oil discharged from the compressor 210. Accordingly, it is possible to prevent problems of an oil shortage in the compressor 210 and an adverse effect on the refrigerant circuit.

Therefore, an amount of oil discharged to the outside of the compressor 210 can be reduced, and the oil can be effectively supplied to the sliding part or the like thereof. As a result, it is possible to improve performance and reliability of the compressor 210.

By disposing the oil separation mechanism 310 in the thick cover 266 of the second rotary compression element 234, an increase in a total length of the compressor can be prevented. As a result, it is possible to miniaturize the compressor 210.

Similarly, by forming the oil hole of the oil passage 314 communicated with the oil separation mechanism 310 in the cover 266, an increase in a total length of the compressor can be prevented, and an increase in the number of components by the formation of the oil passage 314 can be suppressed as much as possible. As a result, it is possible to reduce production costs.

According to the embodiment, the small-diameter passage is formed in the supporting member 254. The small-diameter passage is not limited to this, but it may be formed in the baffle plate 300 or another place in the airtight container 212.

The horizontal type rotary compressor 210 of the embodiment has been described by using the horizontal type rotary compressor of the 2-stage compression type equipped with the first and second rotary compression elements 232, 234. The embodiment is not limited to this, but it may be applied to a horizontal type rotary compressor equipped with a single-stage rotary compression element, or a horizontal type rotary compressor of a multistage compression system equipped with 3, 4 or more stages of rotary compression elements.

According to the embodiment, the carbon dioxide is used for the refrigerant. The refrigerant is not limited to this, but various refrigerants such as a hydrocarbon refrigerant and a nitrous oxide refrigerant can be used.

As described above, according to the present invention, the oil can be effectively separated from the refrigerant compressed by the rotary compression mechanism section by the oil separating means. Thus, it is possible to greatly reduce an amount of oil discharged from the compressor.

Since the oil separated by the oil separating means is extruded from the oil passage by the refrigerant gas therein, oil near the outlet of the oil passage is included by directing the outlet thereof to the oil supplying means. Thus, the oil can easily return to the oil supplying means side.

By the oil separating means, the oil can be effectively separated from the refrigerant compressed by the second rotary compression element. Thus, it is possible to greatly reduce an amount of oil discharged from the compressor.

Furthermore, the oil separated by the oil separating means is passed through the small-diameter passage by using the extrusion speed of the refrigerant gas in the oil separating means. Thus, the small-diameter passage functions as the ejector pump to enable movement of the oil of the oil reservoir of the driving element side of the baffle plate to the rotary compression mechanism section side.

As a result, it is possible to increase the oil level in the oil reservoir of the rotary compression mechanism section side of the baffle plate.

(3) Third Embodiment

Figure 7:
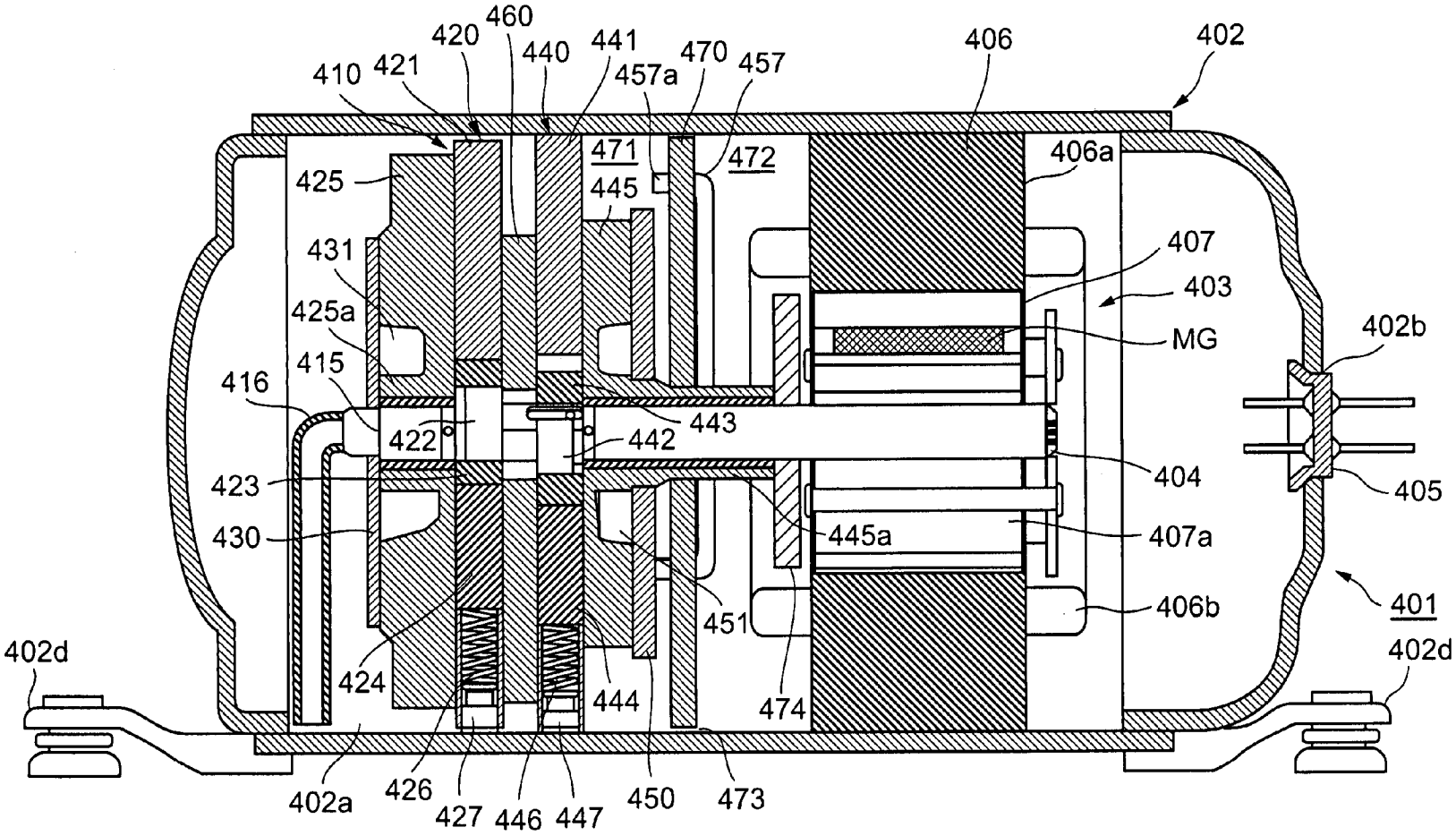
FIG. 7 is a vertical section side view of a horizontal type rotary compressor of a 2-stage compression system according to yet another embodiment of the present invention.
Figure 8:
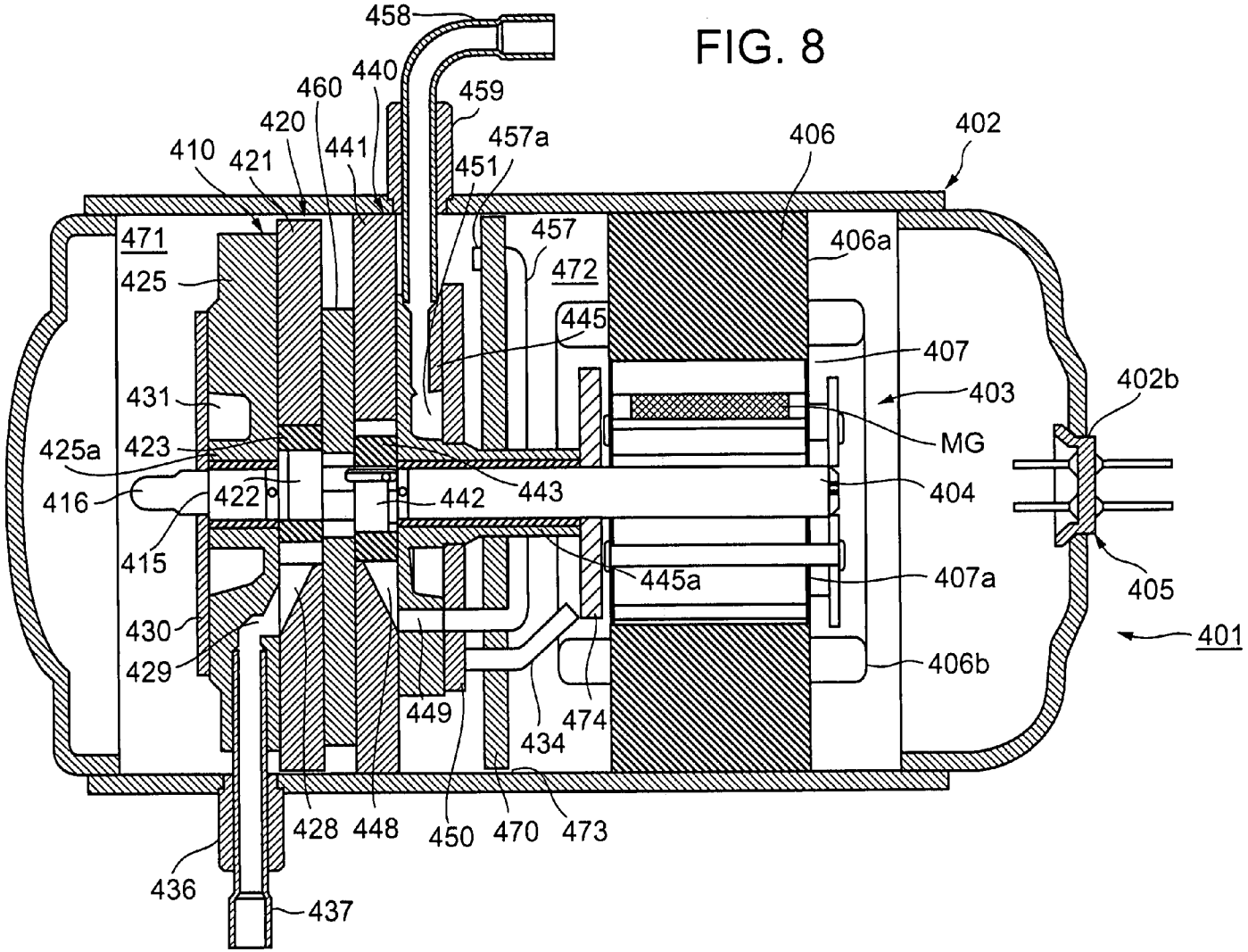
FIG. 8 is a sectional plan view of the horizontal type rotary compressor of the 2-stage compression system of FIG. 7.

Next, detailed description will be made of a horizontal type rotary compressor of a 2-stage compression system according to yet another embodiment of the present invention. FIG. 7 is a vertical section side view of the horizontal type rotary compressor of the multistage compression system of the embodiment, and FIG. 8 is a sectional plan view of the same.

In this case, the horizontal type rotary compressor 401 of the embodiment is an internal intermediate pressure horizontal type rotary compressor of a 2-stage compression system which uses carbon dioxide ($CO_2$) for a refrigerant, and comprises an airtight container 402. A bottom part of the airtight container 402 is an oil reservoir 402*a*. Then, the airtight container 402 contains a motor 403, and a rotary compression mechanism section 410 directly connected to a rotary shaft 404 of the motor 403 to be driven.

The carbon dioxide ($CO_2$) which is a natural refrigerant is selected in consideration of friendliness to a global environment, combustibility, toxicity and the like. As refrigerating machine oil suited to the natural refrigerant, for example, existing refrigerating machine oil such as mineral oil (mineral refrigerating machine oil), alkylbenzene oil, ether oil, ester oil, or polyalkyl glycol (PAG) is sealed in the airtight container 402.

The airtight container 402 is formed into a long-sideways cylindrical shape both ends of which are sealed, and a circular attaching hole 402*b* is formed in an end of the motor 403 side. A terminal 405 is fixed to the attaching hole 402*b* to supply power to the motor 403.

The motor 403 comprises a stator 406 annularly attached along an inner peripheral surface of the airtight container 402, and a rotor 407 inserted and installed by setting a slight space inside the stator 406.

A refrigerating machine oil pump 415 is formed as oil supplying means in an end of the rotary compression mechanism section 410 side of the rotary shaft 404. The refrigerating machine oil pump 415 draws up refrigerating machine oil from the oil reservoir 402*a* formed in a bottom part of the airtight container 402, and supplies this refrigerating machine oil to a sliding part of the rotary compression mechanism section 410 to prevent abrasion thereof. Additionally, the refrigerating machine oil pump 415 comprises a refrigerating machine oil suction pipe 416 to draw up the refrigerating machine oil from the bottom part of the airtight container 402. This refrigerating machine oil suction pipe 416 is vertically lowered from the refrigerating machine oil pump 415 to be opened in the oil reservoir 402*a*.

The stator 406 has a laminated body 406*a* formed by staking doughnut-shaped electromagnetic steel plates, and a stator coil 406*b* wound on a tooth part of the laminated body 406*a* by a series winding (concentrated winding) method. The rotor 407 is constituted of an electromagnetic steel plate laminated body 407*a* as in the case of the stator 406, and a permanent magnet MG is inserted therein. The rotor 407 is fixed to the rotary shaft 404 extended in an axial direction of the airtight container 402.

The rotary compression mechanism section 410 comprises first and second stage compression elements 420 and 440 driven by the rotary shaft 404 of the motor 403. In the airtight container 402, the first and second stage compression elements 420, 440 are arranged in this order from one side (left sides in FIGS. 7 and 8). The first and second stage compression elements 420 and 440 comprise an intermediate partition plate 460, cylinders 421, 441 of the first and second stage compression elements arranged on left and right sides of the intermediate partition plate 460, eccentric parts 422, 442 of the first and second stage compression elements disposed in the rotary shaft 404 with a phase difference of 180°, rollers 423, 443 fitted to the eccentric parts 422, 443 of the same to be eccentrically rotated in the cylinders 421, 441, vanes 424, 444 respectively abutted on the rollers 423, 443 thereof to divide the insides of the cylinders 421, 441 into low-pressure chamber sides and high-pressure chamber sides, and supporting members 425, 445 which close an opening surface of an opposite side of the motor 403 of the cylinder 421 and an opening surface of the motor 403 side of the cylinder 441. Bearings 425*a*, 445*a* for the rotary shaft 404 are formed in the supporting members 425, 445.

Springs 426, 446 are disposed outside the vanes 424, 444 (lower side in FIG. 7), which are abutted on outer ends of the vanes 424, 444 to always press the same to the rollers 423, 443 side. Further, on the airtight container 402 side of the springs 426, 446, metal plugs 427, 447 are disposed to prevent pulling-out thereof. Back pressure chambers (not shown) are formed in the vanes 424, 444, and pressure of a high-pressure chamber side of thereof is applied as back pressure to the back pressure chambers.

As shown in FIG. 8, the supporting members 425, 445 include suction passages communicated through suction ports 428, 448 with low-pressure chamber sides in the cylinders 421, 441, and discharge muffling chambers 431, 451 formed by partially recessing the members 425, 445 and closing the recessed parts with covers 430, 450.

In the horizontal type rotary compressor 401 of the 2-stage compression system, the inside of the airtight container 402 is divided by a baffle plate 470 into a compressor chamber 471 to house the rotary compression mechanism section 410 and a motor chamber 472 to house the motor.

The baffle plate 470 is constituted of a doughnut-shaped steel plate, and fixed to the airtight container 402 by dot-welding separately from the supporting member 445 and by leaving a small aperture from an inner peripheral surface of the airtight container 402 roughly on a full circumference of the outer peripheral end thereof to function as a refrigerant passage and a refrigerating machine oil passage. In a center of the baffle plate 470, the bearing 445*a* of the second stage compression element 440 penetrates the motor 403 side.

The discharge muffling chamber 431 of the first stage compression element 420 is communicated with the inside of the airtight container 402 by an intermediate discharge pipe 434 of the first stage compression element 420 which penetrates the cylinders 421, 441, the intermediate partition plate 460, the cover 450, and the baffle plate 470 to be opened in the motor 403 side.

A refrigerating machine oil collection member 474 made of a permeable material is attached between the bearing 445*a* and the motor 403. This refrigerating machine oil collection member 474 has a disk shape which penetrates a center of the rotary shaft 404. For the permeable material of the refrigerating machine oil collection member 474, a fiber material such as felt, a porous material such as a porous metal, a woven metal wire material or the like is used. A part of a surface of the refrigerating machine oil collection member 474 is firmly attached to an end surface of the bearing 445*a*.

The refrigerating machine oil collection member 474 passes a discharge gas from the first stage compression element 420. When the discharge gas is passed through the refrigerating machine oil collection member 474, refrigerating machine oil contained therein only needs to be stuck to the material thereof to be collected. Thus, this member can be formed into a proper shape by using a proper material other than the above.

As shown in FIG. 8, a tip of the intermediate discharge pipe 434 is bent toward the refrigerating machine oil collection member 474 to be extended close to the same. This constitution is adopted so that a gas refrigerant of intermediate pressure compressed by the first stage compression element 420 can be surely sprayed from the intermediate discharge pipe 434 to the refrigerating machine oil collection member 474 in the motor chamber 472 of the airtight container 402.

A suction port 457*a* of an intermediate suction pipe 457 of the second stage compression element 440 is positioned in an upper part of the compressor chamber 471. By this constitution, a gas refrigerant of the compressor chamber 471 is sucked through the intermediate suction pipe 457 and a suction passage 449 into the cylinder 441 of the second stage compression element 440. The suction pipe 457 is arranged to penetrate the baffle plate 470 and in contact with the surface of the motor chamber 472 side of the baffle plate 470, and a tip thereof is connected to the suction passage 449 of the second stage compression element 440.

A suction pipe 437 of the first stage compression element 420 is pulled through a sleeve 436 attached to a side of the supporting member 425 on the side face of the airtight container 402 to the outside thereof. A discharge pipe 458 of the second stage compression element 440 is pulled through a sleeve 459 attached to a side of the supporting member 445 on the side face of the airtight container 402 to the outside thereof.

Incidentally, attaching pedestals 402*d* are disposed in both ends of the bottom part of the airtight container 402 in a longitudinal direction (see FIG. 7).

Next, an operation of the horizontal type rotary compressor 401 of the 2-stage compression system of the foregoing constitution will be described.

To begin with, when the stator coil 406*b* of the motor 403 is energized through a terminal 405 and a wiring (not shown), the motor 403 is started to rotate the rotor 407. This rotation is accompanied by rotation of the eccentric parts 422, 442 integrally disposed with the rotary shaft 404, and the rollers 423, 443 fitted to the eccentric parts 422, 442 are eccentrically rotated in the cylinders 421, 441.

Accordingly, a refrigerant of the refrigerant circuit (not shown) connected to the outside of the horizontal type rotary compressor 401 of the 2-stage compression system is passed through the suction pipe 437, the suction passage 429 and the suction port 428 of the first stage compression element 420, and sucked into the low-pressure chamber side of the cylinder 421 of the first stage compression element 420. The gas refrigerant sucked into the low-pressure chamber side of the cylinder 421 is compressed by operating the roller 423 and the vane 424 to become intermediate pressure, and discharged from the high-pressure chamber side of the cylinder 421 through the intermediate discharge pipe 434 to be sprayed to the refrigerating machine oil collection member 474 in the motor chamber 472.

When the gas refrigerant of the intermediate pressure is sprayed to the refrigerating machine oil collection member 474, a part thereof is passed through the refrigerating machine oil collection member 474, and a part of refrigerating machine oil contained in the gas refrigerant is stuck to the material thereof to be collected and separated.

Residual refrigerating machine oil contained in the gas refrigerant of the intermediate pressure sprayed to the motor chamber 472 is subjected to gas-liquid separation therein. In this case, since a suction port 457*a* of the intermediate suction pipe 457 of the second stage compression element 440 is located in the motor chamber 472 and the compressor chamber 471 plotted by the baffle plate 470, a separation operation of the refrigerating machine oil from the gas refrigerant is facilitated in the motor chamber 472. Thus, the refrigerating machine oil separated in the motor chamber 472 is stored in the oil reservoir 402*a* in the bottom part of the airtight container 2.

The gas refrigerant sprayed into the motor chamber 472 is subjected to refrigerant machine oil separation, and then flows through the aperture 473 formed as the refrigerant passage and the refrigerating machine oil passage between the baffle plate 470 and the airtight container 402 into the compressor chamber 471. The gas refrigerant of the intermediate pressure that has flowed into the compressor chamber 471 is sucked from the suction port 457*a* opened in the upper part of the compressor chamber 471 through the suction pipe 457 and the suction passage 449 into the cylinder 441 of the second stage compression element 440. Then, the gas refrigerant is subjected to compression of a second stage by rotating the roller 443 and the vane 444 to become a high-pressure and high-temperature gas refrigerant, and then discharged through a discharge port (not shown), the discharge muffling chamber 451 formed in the supporting member 445, and the discharge pipe 458 to the external refrigerant circuit.

The inside of the airtight container 402 is constituted so that a flow of a refrigerant can be generated through the aperture 473 formed in the outer circumference of the baffle plate 470 as described above. By forming this aperture 473 to a proper size, proper differential pressure can be generated between left and right sides of the baffle plate 470, i.e., between the motor chamber 472 and the compressor chamber 471, and pressure of the motor chamber 472 can be set higher than that of the compressor chamber 471.

Such a pressure difference causes a pressure difference between the motor chamber 472 and the low-pressure chamber side of the cylinder 441 which confront each other by sandwiching the bearing 445*a*, and the pressure of the motor chamber 472 becomes higher than that of the low-pressure chamber of the cylinder 441. As a result, a part of the refrigerating machine oil stuck to the refrigerating machine oil collection member 474 to be stored drops to the oil reservoir 402*a* located below, while a remaining part is supplied through an aperture of the bearing 445*a* into the cylinder 441 by the pressure difference between the motor chamber 472 and the compressor chamber 471. Thus, it is possible to supply sufficient refrigerating machine oil into the cylinder 441 of the second stage compression element 440 which has not been easy conventionally.

Figure 9:
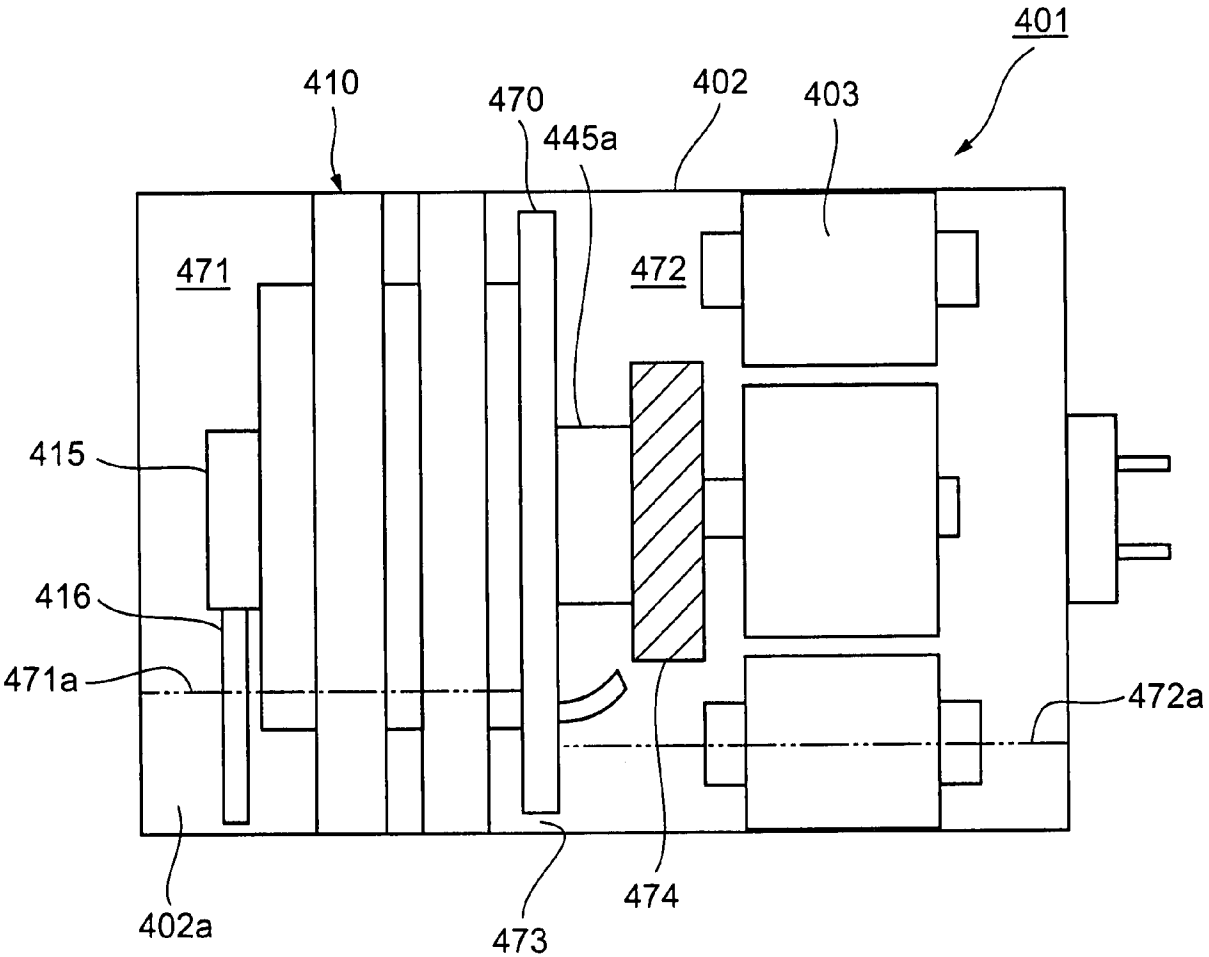
FIG. 9 is a view illustrating an oil surface state of an oil reservoir in the horizontal type rotary compressor of the 2-stage compression system of FIG. 7.

Meanwhile, the refrigerating machine oil dropped from the refrigerating machine oil collection member 474, and the refrigerating machine oil separated in the motor chamber 472 without being collected by the refrigerating machine oil collection member 474 are stored in the oil reservoir 402*a*, while a part of the oil flows through the aperture 473 formed in the outer circumference of the baffle plate 474 into the compressor chamber 471. Additionally, since the pressure of the compressor chamber 471 becomes lower compared with that of the motor chamber 472 as described above, as shown in FIG. 9, an oil surface 471*a* of the refrigerating machine oil of the compressor chamber 471 becomes higher than an oil surface 472*a* of the motor chamber 472. Thus, since the opening of the refrigerating machine oil suction pipe 416 is dipped in the refrigerating machine oil without any problems, the refrigerating machine oil is smoothly supplied to the sliding part of the rotary compression mechanism section 410 by the refrigerating machine oil pump 415. Moreover, since the oil surface 471*a* of the compressor chamber 471 side becomes high as described above, sufficient refrigerating machine oil can be supplied to the rotary compression mechanism section 410 without increasing an amount of refrigerating machine oil sealed in the airtight container 402.

Since the intermediate suction pipe 457 of the second stage compression element 440 is passed through the motor chamber 472 to execute suction, a heating effect by heat generation of the rotary compression mechanism section 410 is suppressed. Thus, a temperature of the gas refrigerant sucked into the second compression element 440 is lowered to increase compression efficiency thereof.

According to the embodiment, the intermediate suction pipe 457 is in contact with the surface of the baffle plate 470. However, if it is isolated, heating of the sucked gas refrigerant of the second stage compression element 440 by heat generation of the rotary compression mechanism section 410 is suppressed more to enable a further increase in the compression efficiency thereof.

According to the embodiment, the aperture 473 between the outer peripheral surface of the baffle plate 470 and the inner surface of the airtight container 402 is used as the refrigerant passage and the refrigerating machine oil passage from the motor chamber 472 to the compressor chamber 471. However, the invention is not limited to this. For example, without disposing the aperture 473, a hole of a proper size may be disposed in the lower part of the baffle plate 470 as a refrigerating machine oil passage to pass the refrigerating machine oil, and a hole of a proper size may be disposed in the upper part of the baffle plate 470 as a refrigerant passage to pass the refrigerant.

According to the embodiment, the carbon dioxide ($CO_2$) is used for the refrigerant. However, the invention is not limited to this refrigerant. The invention can be implemented by using hydrocarbon (HC), ammonium ($NH_3$) or the like.

The embodiment has been described by taking the example of the horizontal type rotary compressor 401 of the 2-stage compression system. However, the invention is not limited to this example. The invention can be applied to a horizontal type rotary compressor of a multistage compression system in which the rotary compression mechanism 410 has 3, 4, or more stages.

The horizontal type rotary compressor 401 of the multistage compression system of the invention can be used for a home air conditioner, a business air conditioner (package air conditioner), an automobile air conditioner, a heat pump system water heater, a home refrigerator, a business refrigerator, a business freezer, a business refrigerator-freezer, an automatic vending machine, and the like.

Especially, the horizontal type rotary compressor of the multistage compressor of the invention is suitable for the automobile air conditioner run under harsh conditions as it can supply sufficient refrigerating machine oil into the cylinder 441 of the second stage compression element 440. Additionally, if a carbon dioxide gas is used for a refrigerant, the compressor is suitable for the heat pump system water heater since high-temperature hot water is easily obtained.

Thus, the horizontal type rotary compressor of the multistage compression system of the invention comprises the baffle plate disposed between the rotary compression mechanism section and the motor to divide the inside of the airtight container into the compressor chamber to house the rotary compression mechanism section and the motor chamber to house the motor, and the refrigerant distribution passage and the refrigerating machine oil distribution passage for distributing the refrigerant and the refrigerating machine oil from the motor chamber to the compressor chamber, and is constituted in such a manner that the discharged gas refrigerant of the first stage compression element is discharged into the motor chamber, and the gas refrigerant which flows from the motor chamber into the compressor chamber is sucked into the second stage compression element. Thus, the discharged gas from the first stage compression element temporarily stays in the motor chamber to facilitate separation of refrigerating machine oil therefrom. The separated refrigerating machine oil is stored in the oil reservoir in the bottom part of the motor chamber, and flows through the refrigerating machine oil passage into the bottom part of the compressor chamber.

Since the gas discharged from the first stage compression element into the motor chamber flows through the refrigerant passage into the motor chamber, the pressure of the motor chamber becomes higher than that of the compressor chamber. Thus, the pressure of the low-pressure chamber side in the cylinder of the second stage compression element becomes lower than that of the motor chamber.

Further, since the discharged gas of the first stage compression element is sprayed to the refrigerating machine oil collection member made of the permeable material disposed in contact with the bearing end surface of the second stage compression element, while the discharged gas of the first stage compression element is passed through the refrigerating machine oil collection member, the refrigerating machine oil contained therein is stuck to the refrigerating machine oil to be separated. Thus, a separation effect of the refrigerating machine oil in the motor chamber is further improved.

The refrigerating machine oil stuck to the refrigerating machine oil collection member made of the permeable material to be collected flows through the aperture of the bearing of the second stage compression element into the cylinder because of the pressure difference between the motor chamber and the low-pressure chamber side in the cylinder of the second stage compression element. Therefore, in the horizontal type rotary compressor of the multistage compression system of the invention, necessary refrigerating machine oil can be supplied to the second stage compression element.

Furthermore, an automobile air conditioner of the present invention can be used even under an excessive load by using a refrigerant friendly to an environment since it is constituted of the horizontal type rotary compressor of the multistage compression system and a carbon dioxide gas is used for a refrigerant.

(4) Fourth Embodiment

Figure 10:
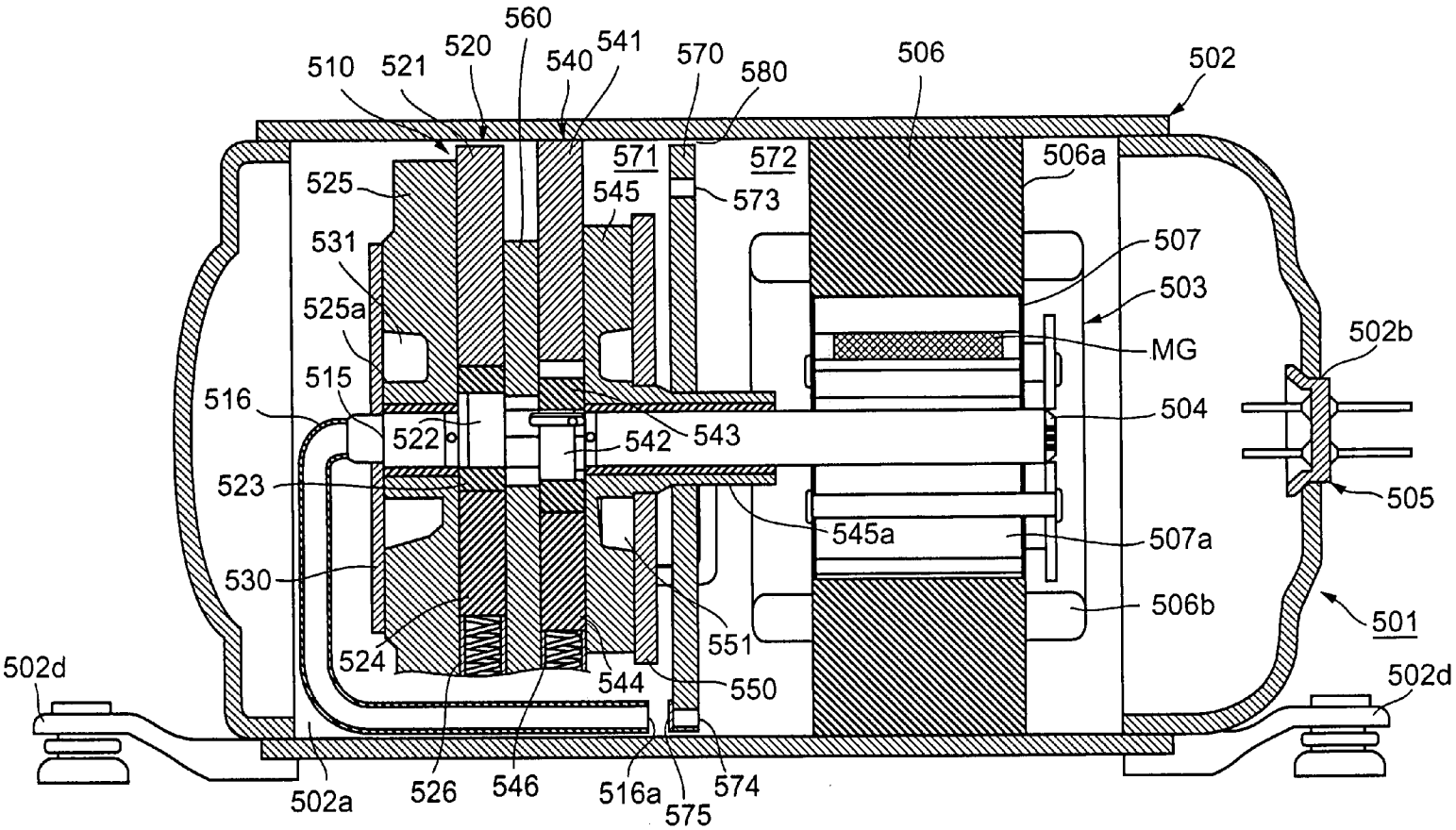
FIG. 10 is a vertical section side view of a horizontal type rotary compressor of a 2-stage compression system according to yet another embodiment of the present invention.
Figure 11:
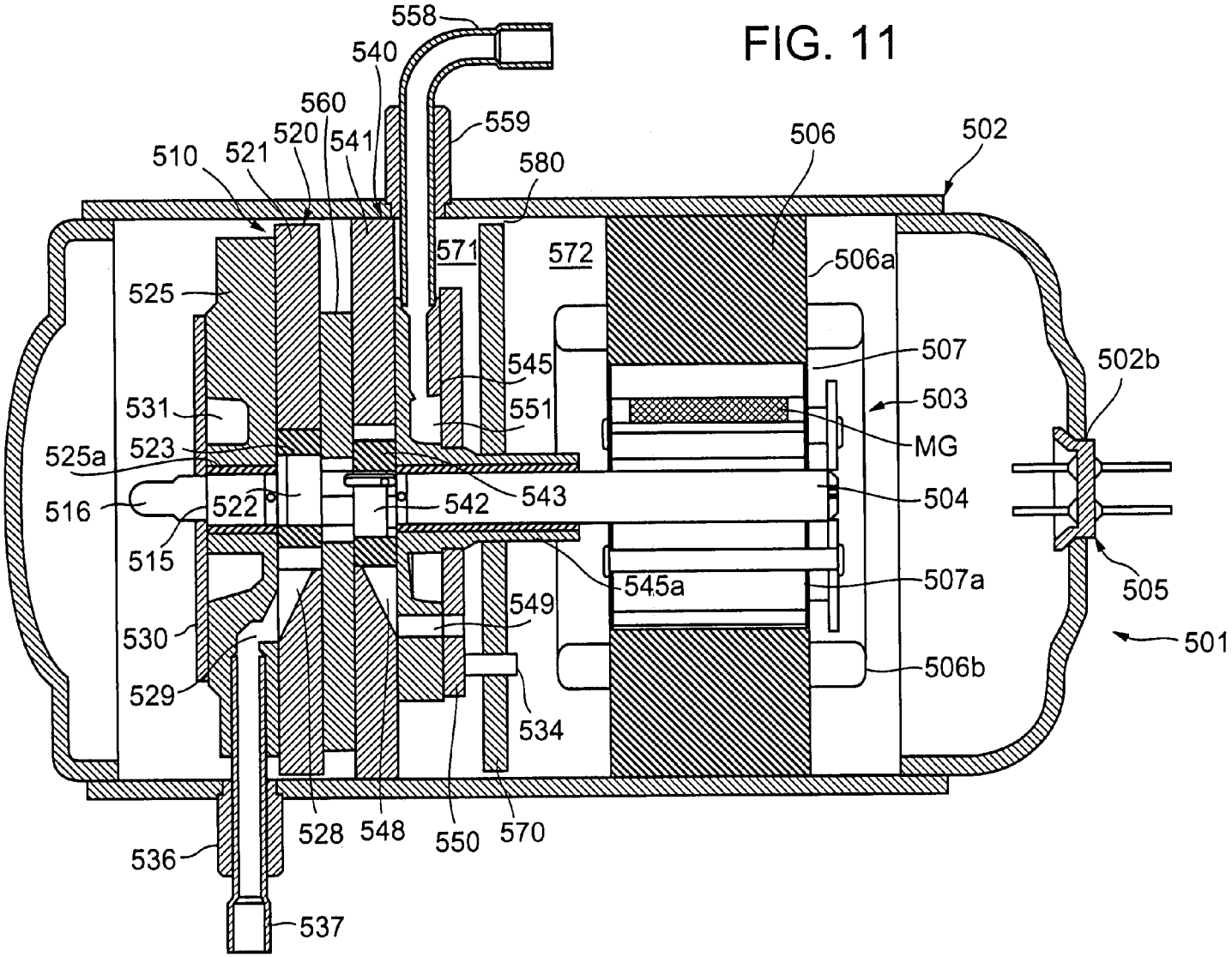
FIG. 11 is a sectional plan view of the horizontal type rotary compressor of the 2-stage compression system.
Figure 12:
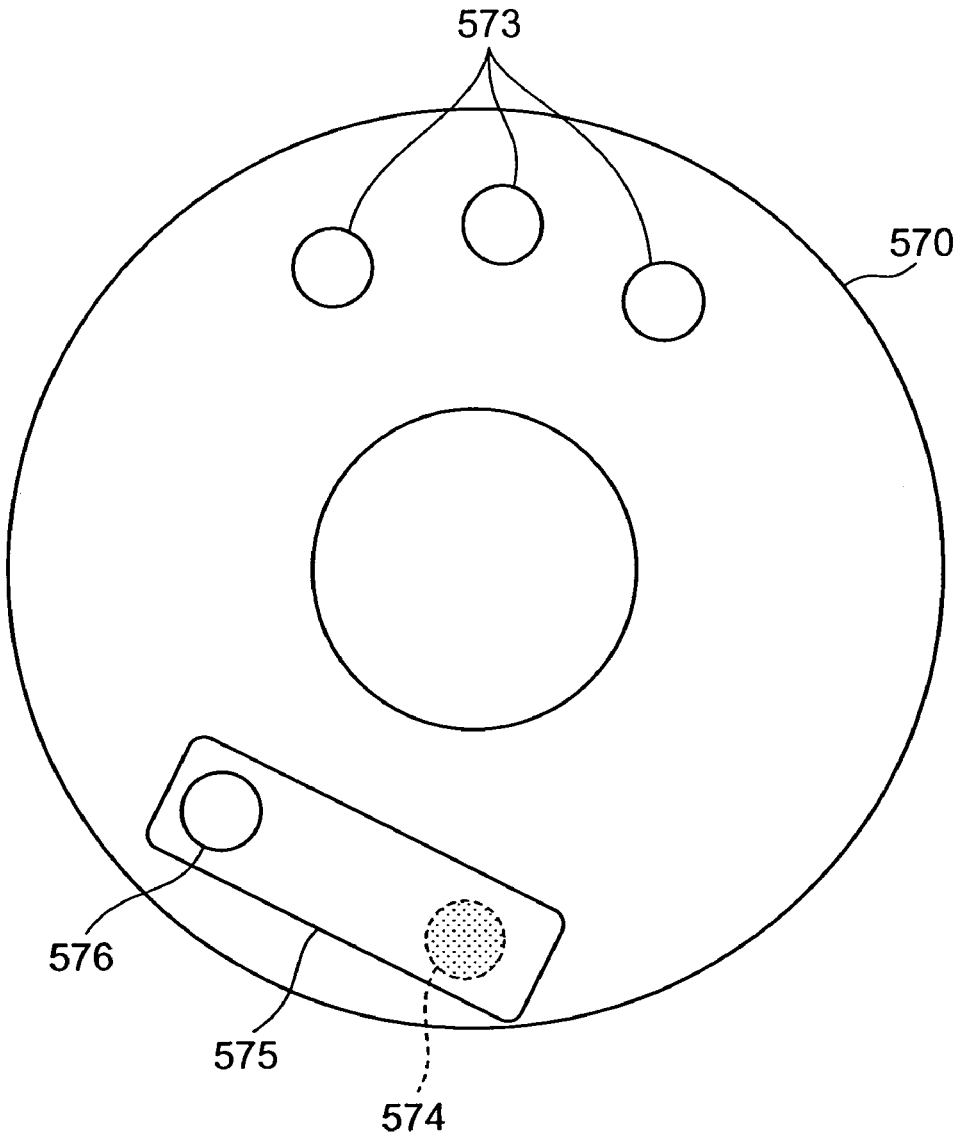
FIG. 12 is a side view of a baffle plate in the horizontal type rotary compressor of the 2-stage compression system.

Next, detailed description will be made of a horizontal type rotary compressor of a 2-stage compression system according to yet another embodiment of the present invention. FIG. 10 is a vertical section side view of the horizontal type rotary compressor of the 2-stage compression system of the embodiment, FIG. 11 is a sectional plan view of the same, and FIG. 12 is a side view of a baffle plate in the same.

In this case, the horizontal type rotary compressor 501 of the 2-stage compression system of the embodiment is an internal intermediate pressure horizontal type rotary compressor of the 2-stage compression system which uses carbon dioxide ($CO_2$) for a refrigerant, and comprises an airtight container 502. A bottom part of the airtight container 502 is an oil reservoir 502*a*. Then, the airtight container 402 contains a motor 503, and a rotary compression mechanism section 510 directly connected to a rotary shaft 504 of the motor 503 to be driven.

The carbon dioxide ($CO_2$) which is a natural refrigerant is selected in consideration of friendliness to a global environment, combustibility, toxicity and the like. As refrigerating machine oil suited to the natural refrigerant, for example, existing refrigerating machine oil such as mineral oil (mineral refrigerating machine oil), alkylbenzene oil, ether oil, ester oil, or polyalkyl glycol (PAG) is sealed in the airtight container 502.

The airtight container 502 is formed into a long-sideways cylindrical shape both ends of which are sealed, and a circular attaching hole 502*b* is formed in an end of the motor 503 side. A terminal 505 is fixed to the attaching hole 502*b* to supply power to the motor 503.

The motor 503 comprises a rotary shaft 504, a stator 506 annularly attached along an inner peripheral surface of the airtight container 502, and a rotor 507 inserted and installed by setting a slight space inside the stator 506.

A pump mechanism 515 is formed as oil supplying means in an end of the rotary compression mechanism section 510 side of the rotary shaft 504. The pump mechanism 515 draws up refrigerating machine oil from an oil reservoir 502*a* formed in a bottom part of the airtight container 502, and supplies this refrigerating machine oil to a sliding part of the rotary compression mechanism section 510 to prevent abrasion thereof. Additionally, the pump mechanism 515 comprises a refrigerating machine oil suction pipe 516 to draw up the refrigerating machine oil from the bottom part of the airtight container 502. This refrigerating machine oil suction pipe 516 is lowered from the pump mechanism 515 in the oil reservoir 502*a*, bent to the motor 503 side in the bottom part of the airtight container 502, and extended close to a baffle plate 570 (described later), thereby forming an opening 516*a* near the same.

The stator 506 has a laminated body 506*a* formed by staking doughnut-shaped electromagnetic steel plates, and a stator coil 506*b* wound on a tooth part of the laminated body 506*a* by a series winding (concentrated winding) method. The rotor 507 is constituted of an electromagnetic steel plate laminated body 507*a* as in the case of the stator 506, and a permanent magnet MG is inserted therein. The rotor 507 is fixed to the rotary shaft 504 extended in an axial direction of the airtight container 502.

The rotary compression mechanism section 510 comprises first and second stage compression elements 520 and 540 driven by the rotary shaft 504 of the motor 503. In the airtight container 502, the first and second stage compression elements 520, 540 are arranged in this order from one side (left sides in FIGS. 10 and 11). The first and second stage compression elements 520 and 540 comprise an intermediate partition plate 560, cylinders 521, 541 of the first and second stage compression elements arranged on left and right sides of the intermediate partition plate 560, eccentric parts 522, 542 of the first and second stage compression elements disposed in the rotary shaft 504 with a phase difference of 180°, rollers 523, 543 fitted to the eccentric parts 522, 543 of the same to be eccentrically rotated in the cylinders 521, 541, vanes 524, 544 respectively abutted on the rollers 523, 543 thereof to divide the insides of the cylinders 521, 541 into low-pressure chamber sides and high-pressure chamber sides, and supporting members 525, 545 which close an opening surface of an opposite side of the motor 503 of the cylinder 521 and an opening surface of the motor 503 side of the cylinder 541. Bearings 525*a*, 545*a* for the rotary shaft 504 are formed in the supporting members 525, 545.

Springs 526, 546 are disposed outside the vanes 524, 544 (lower side in FIG. 10), which are abutted on outer ends of the vanes 524, 544 to always press the same to the rollers 523, 543 side. Further, on the airtight container 502 side of the springs 526, 546, metal plugs (not shown) are disposed to prevent pulling-out thereof. Back pressure chambers (not shown) are formed in the vanes 524, 544, and pressure of a high-pressure chamber side of thereof is applied as back pressure to the back pressure chambers.

As shown in FIG. 11, the supporting members 525, 545 include suction passages 529, 549 communicated through suction ports 528, 548 with low-pressure chamber sides in the cylinders 521, 541, and discharge muffling chambers 531, 551 formed by partially recessing the members 525, 545 and closing the recessed parts with covers 530, 550.

In the horizontal type rotary compressor 501 of the 2-stage compression system, the inside of the airtight container 502 is divided by the circular flat platelike baffle plate 570 made of a steel plate into a compressor chamber 571 to house the rotary compression mechanism section 510 and a motor chamber 572 to house the motor. Additionally, a small aperture 580 is formed between an outer peripheral end surface of the baffle plate 570 and an inner peripheral surface of the airtight container 502.

As shown in FIGS. 10 and 12, a plurality of refrigerant distribution holes 573 (three in this case) are formed in an upper part of the baffle plate 570 to distribute a refrigerant from the motor chamber 572 to the compressor chamber 571. A refrigerating machine oil distribution hole 574 is formed in a lower part of the baffle plate 570 to distribute refrigerating machine oil from the motor chamber 572 to the compressor chamber 571. Additionally, a check valve 575 is disposed in the refrigerating machine oil distribution hole 574 to prevent distribution of the refrigerating machine oil from the compressor chamber 571 side to the motor chamber 572 side. This check valve 575 is a so-called platelike lead valve, one end of which closes the refrigerating machine oil distribution hole 574 and the other end of which is fixed to a surface of the compressor chamber 571 side of the baffle plate 570 by a screw 576. For the platelike check valve 575, a soft elastic material is used so that the valve can be opened by a small pressure difference generated between the motor chamber 572 and the compressor chamber 571.

The discharge muffling chamber 531 of the first stage compression element 520 is communicated with the inside of the motor chamber 572 by an intermediate discharge pipe 534 of the first stage compression element 520 which penetrates the cylinders 521, 541, the intermediate partition plate 560, the cover 550, and the baffle plate 570.

The second stage compression element 540 is constituted to suck a gas refrigerant of the compressor chamber 571 into the cylinder 541 thereof through the suction passage 549 opened in the compressor chamber 571.

A suction pipe 537 of the first stage compression element 520 is pulled through a sleeve 536 attached to a side of the supporting member 525 on the side face of the airtight container 502 to the outside thereof. A discharge pipe 558 of the second stage compression element 540 is pulled through a sleeve 559 attached to a side of the supporting member 545 on the side face of the airtight container 502 to the outside thereof.

Incidentally, attaching pedestals 502*d* are disposed in both ends of the bottom part of the airtight container 502 in a longitudinal direction (see FIG. 10).

Next, an operation of the horizontal type rotary compressor 501 of the 2-stage compression system of the foregoing constitution will be described.

To begin with, when the stator coil 506*b* of the motor 503 is energized through a terminal 505 and a wiring (not shown), the motor 503 is started to rotate the rotor 507. This rotation is accompanied by rotation of the eccentric parts 522, 542 integrally disposed with the rotary shaft 504, and the rollers 523, 543 fitted to the eccentric parts 522, 542 are eccentrically rotated in the cylinders 521, 541.

Accordingly, a refrigerant of a refrigerant circuit (not shown) connected to the outside of the horizontal type rotary compressor 501 of the 2-stage compression system is passed through the suction pipe 537, the suction passage 529 and the suction port 528 of the first stage compression element 520, and sucked into the low-pressure chamber side of the cylinder 521 of the first stage compression element 520. The gas refrigerant sucked into the low-pressure chamber side of the cylinder 521 is compressed by operating the roller 523 and the vane 524 to become intermediate pressure, and discharged through the intermediate discharge pipe 534 into the motor chamber 572 in the airtight container 502.

The gas refrigerant of the intermediate pressure discharged to the motor chamber 572 contains refrigerating machine oil. The refrigerating machine oil contained in the gas refrigerant of the intermediate pressure is separated in the motor chamber 572 to be stored in the oil reservoir 502*a* in the bottom part thereof.

The gas refrigerant discharged into the motor chamber 572 is subjected to refrigerant machine oil separation, and then flows through the aperture 580 formed between the outer peripheral end surface of the baffle plate 570 and the inner surface of the airtight container 502 and through the refrigerant distribution hole 573 formed in the upper part of the baffle plate 570 into the compressor chamber 571.

The gas refrigerant of the intermediate pressure that has flowed into the compressor chamber 571 is sucked through the suction passage 549 opened in the compressor chamber 571 into the cylinder 541 of the second stage compression element 540. Then, the gas refrigerant is subjected to compression of a second stage by rotating the roller 543 and the vane 544 to become a high-pressure and high-temperature gas refrigerant, and then discharged through a discharge port (not shown), the discharge muffling chamber 551 formed in the supporting member 545, and the discharge pipe 558 to the external refrigerant circuit (not shown).

Since such a flow of a refrigerant is formed, the separation operation of the refrigerating machine oil in the motor chamber 582 can be efficiently carried out without any direct suction of the discharged gas of the intermediate pressure from the first stage compression element 520 to the second stage compression element 540.

As described above, in the airtight container 502, a flow of a refrigerant is generated through the aperture 580 and the refrigerant distribution hole 573. By forming the aperture 573 and the refrigerant distribution hole 573 to proper sizes, proper differential pressure is generated between left and right sides of the baffle plate 570, i.e., between the motor chamber 572 and the compressor chamber 571. That is, pressure of the motor chamber 572 is set higher than that of the compressor chamber 571.

Such a proper pressure difference generated between the motor chamber 572 and the compressor chamber 571 opens the check valve 575 attached to the lower part of the baffle plate 570. Thus, the refrigerating machine oil separated in the motor chamber 572 and stored in the oil reservoir 502*a* thereof flows through the aperture 580 of the bottom part and the refrigerating machine oil distribution hole 574 into the compressor chamber 571 side when an oil surface 572*a* in the motor chamber 572 is higher than the refrigerating machine oil distribution hole 574.

Figure 13A:
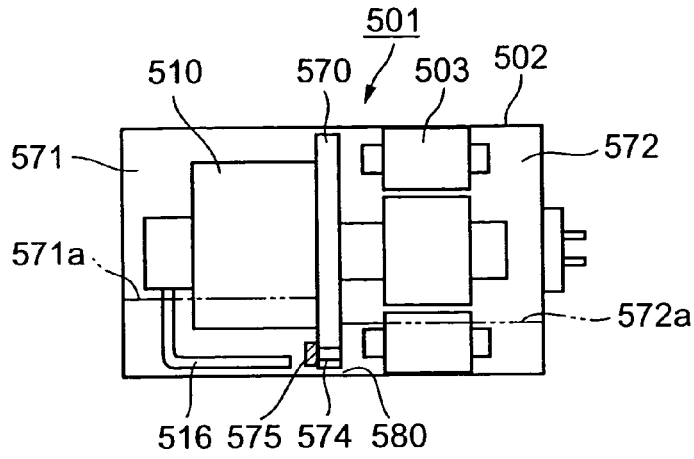
FIGS. 13A to 13C are views showing oil surface states of an oil reservoir in the horizontal type rotary compressor of the 2-stage compression system of FIG. 10.

Since the pressure of the compressor chamber 571 is lower than that of the motor chamber 572 as described above, in a horizontally held state of the horizontal type rotary compressor 501 of the 2-stage compression system, an oil surface 571*a* of the refrigerating machine oil of the compressor chamber 571 side becomes higher compared with the oil surface 572*a* of the motor chamber 572 side as shown in FIG. 13A. Accordingly, since an opening 516*a* of the refrigerating machine oil suction pipe 516 is dipped in the refrigerating machine oil without any problems, the refrigerating machine oil is smoothly supplied to the sliding part of the rotary compression mechanism section 510 by the pump mechanism 515.

Figure 13B:
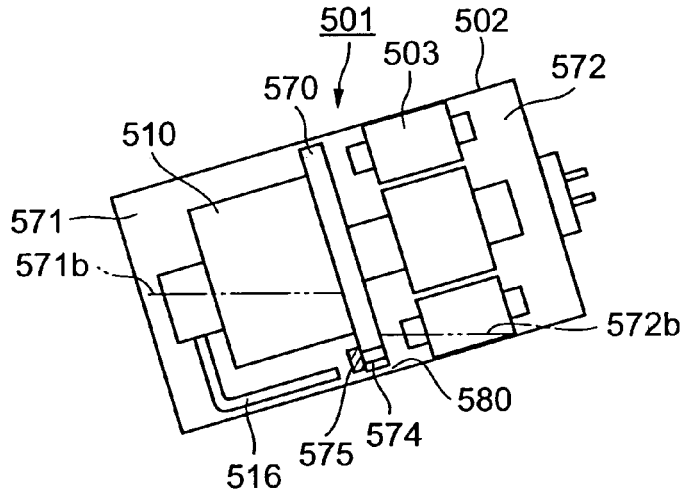

Next, when the horizontal type rotary compressor 501 of the 2-stage compression system is inclined from the horizontal state to the rotary compression mechanism section 510 side as shown in FIG. 13B, since the compression chamber 571 is located in a lower part, the refrigerating machine oil of the motor chamber 572 further flows through the aperture 580 and the refrigerating machine oil distribution hole 574 into the compressor chamber 571 side. As a result, an oil surface 571*b* of the compressor chamber 571 becomes higher than that in the state of FIG. 13A. Thus, in this case, drawing-up of the refrigerating machine oil is carried out without any problems. Incidentally, a reference numeral 572*b* in FIG. 13B denotes an oil surface of the motor chamber 572 in the inclined state.

Figure 13C:
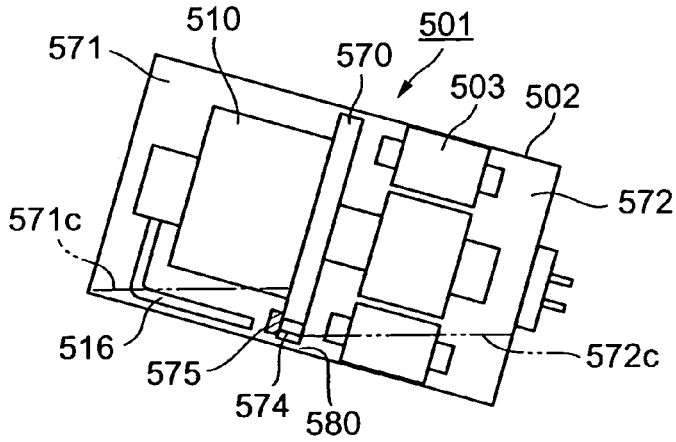

When the horizontal type rotary compressor 501 of the 2-stage compression system is inclined from the horizontal state to the motor 503 side as shown in FIG. 13C, since the compressor chamber 571 is located above the motor chamber 572, the refrigerating machine oil of the compressor chamber 571 easily flows therefrom to the motor chamber 572 side. However, since the check valve 575 is disposed in the refrigerating machine oil distribution hole 574, reverse dashing of the refrigerating machine oil of the compressor chamber 571 into the motor chamber 572 is prevented. Additionally, if this state is maintained for a certain period of time, the refrigerating machine oil of the compressor chamber 571 flows through the aperture 580 of the bottom part of the airtight container 502 to the motor chamber 572 side. Thus, an oil surface 572*c* of the motor chamber 572 is increased to a height of the refrigerating machine oil distribution hole 574 of the baffle plate side.

However, even in this state, since an oil surface 571*c* near the baffle plate 570 of the compressor chamber 571 side is above the refrigerating machine oil distribution hole 574 as shown in FIG. 13C, the opening 516*a* of the refrigerating machine oil suction pipe 516 is not positioned above the oil surface, and thus drawing-up of the refrigerating machine oil is smoothly carried out.

When the horizontal type rotary compressor 501 of the 2-stage compression system is inclined to one of the rotary compression mechanism section 510 side or the motor 503 side, and strong vibration is applied thereto from the outside, the oil surfaces 571*a*, 571*b*, and 571*c* in which the opening 516*a* of the refrigerating machine oil suction pipe 516 is positioned are greatly changed up and down. However, because of the aforementioned constitution in which the oil surface of the opening 516*a* part becomes high, there is little danger that the opening 516*a* will jump above the oil surfaces 571*a*, 571*b*, and 571*c*.

According to the horizontal type rotary compressor 501 of the 2-stage compression system of the embodiment, even if it is inclined to one of the rotary compression mechanism section side and the motor side, further even if strong vibration is applied from the outside in addition to the inclination, it is possible to draw up the refrigerating machine oil as long as the inclination and the vibration are not excessive.

Thus, even if the horizontal type rotary compressor 501 of the 2-stage compression system of the embodiment is applied to an automobile air conditioner of large inclination and vibration, sufficient refrigerating machine oil can be drawn up. Moreover, sufficient refrigerating machine oil can be supplied to the rotary compression mechanism section 510 without increasing an amount of refrigerating machine oil sealed in the airtight container 502.

According to the embodiment, the refrigerant distribution hole 573 is formed in the baffle plate 570. However, if a sufficient size of the aperture 580 is secured, this refrigerant distribution hole 573 can be omitted.

According to the embodiment, the carbon dioxide ($CO_2$) is used for the refrigerant. However, the invention is not limited to this refrigerant. The invention can be implemented by using hydrocarbon (HC), ammonium ($NH_3$) or the like.

The embodiment has been described by taking the example of the horizontal type rotary compressor 501 of the 2-stage compression system. However, the invention is not limited to this example. The invention can be applied to a horizontal type rotary compressor of a multistage compression system in which the rotary compression mechanism 510 has 3, 4, or more stages.

The rotary compressor of the multistage compression system of the invention can be used for a home air conditioner, a business air conditioner (package air conditioner), an automobile air conditioner, a heat pump system water heater, a home refrigerator, a business refrigerator, a business freezer, a business refrigerator-freezer, an automatic vending machine, and the like.

Thus, the horizontal type rotary compressor of the embodiment comprises the baffle plate to divide the inside of the airtight container into the compressor chamber and the motor chamber, and the aperture formed between the outer peripheral end surface of the baffle plate and the inner peripheral surface of the airtight container, and is constituted in such a manner that the discharged gas refrigerant of the first stage compression element is discharged into the motor chamber, and the gas refrigerant which flows from the motor chamber into the compressor chamber is sucked into the second stage compression element. Thus, the pressure of the motor chamber can be maintained higher than that of the compressor chamber, whereby the oil surface of the compressor chamber can be increased. Additionally, since the opening of the tip of the refrigerating machine oil suction pipe of the pump mechanism disposed in the end of the rotary compression mechanism section side of the motor is arranged near the baffle plate of the oil reservoir, even if the compressor is inclined toward the motor side, the opening of the tip of the refrigerating machine oil suction pipe can be easily maintained below the oil surface. Moreover, even if the oil surface is greatly changed up and down in use in which strong vibration is applied to the compressor from the outside, the opening of the tip of the refrigerating machine oil can be easily maintained below the oil surface.

If the refrigerating machine oil distribution hole and the check valve are disposed in the lower part of the baffle plate respectively to distribute the refrigerating machine oil and to prevent a reverse flow of the refrigerating machine oil through the refrigerating machine oil distribution hole from the compressor chamber to the motor chamber, the refrigerating machine oil of the motor chamber easily moves to the compressor chamber side when the oil surface of the motor chamber side is increased. Moreover, the refrigerating machine oil that has moved to the compressor side never returns through the refrigerating machine oil distribution hole to the motor chamber side. Thus, more refrigerating machine oil can be easily maintained in the compressor chamber. As a result, in the case of such a constitution, it is possible to expand an inclination range which enables use of the compressor and a durable vibration state.

Furthermore, an automobile air conditioner of the present invention uses the horizontal type rotary compressor of the multistage compression system usable in the inclined state and the vibrated state as described above. Thus, it is possible to provide a horizontal type rotary compressor of a multistage compression system suited to an automobile air conditioner which frequently becomes an inclined state and to which violent vibration is applied. Moreover, since a carbon dioxide gas is used for a refrigerant, it is possible to provide an automobile air conditioner excellent in global environment preservation.

(5) Fifth Embodiment

Figure 14:
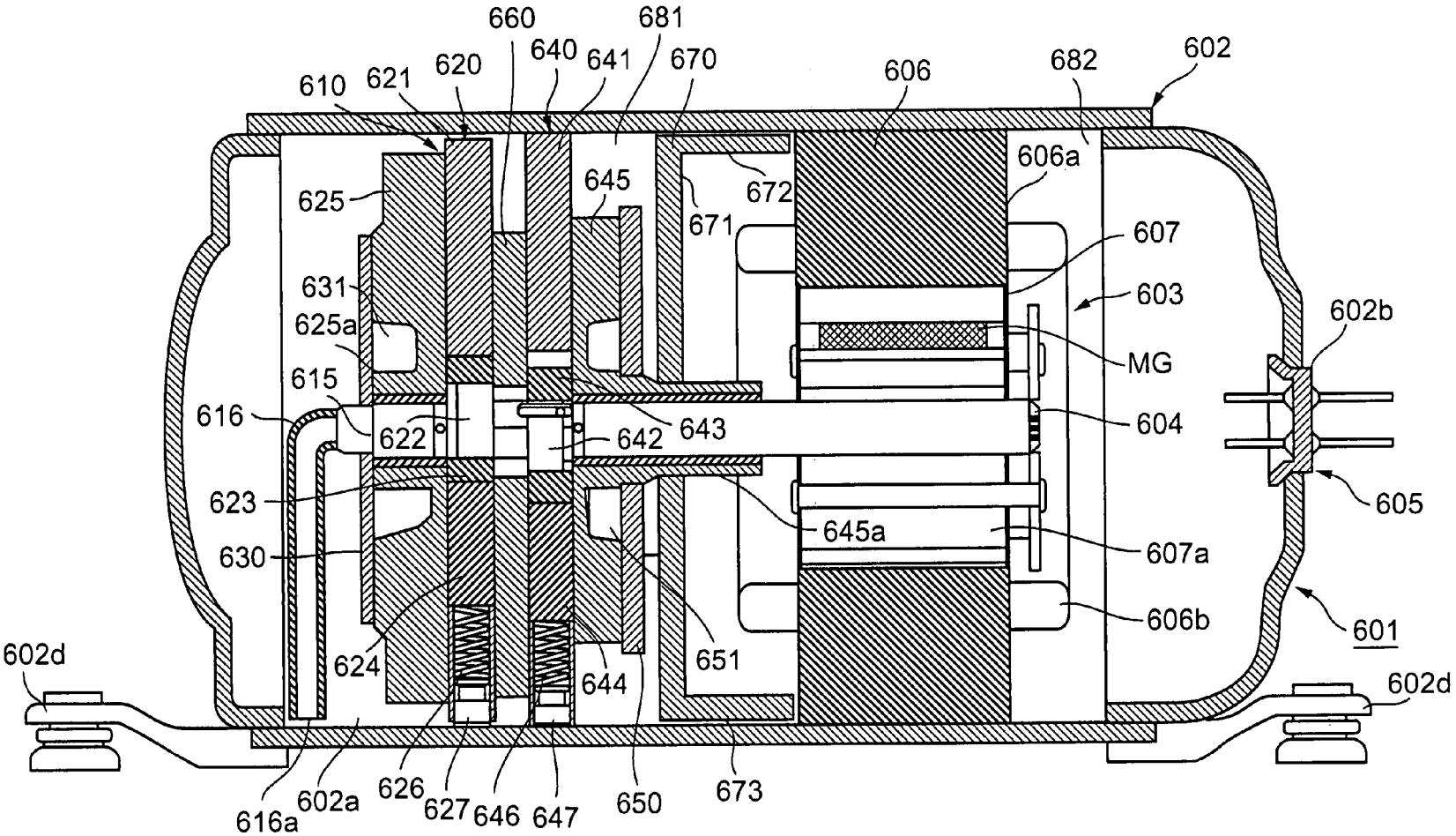
FIG. 14 is a vertical section side view of a horizontal type rotary compressor of a 2-stage compression system according to yet another embodiment of the present invention.
Figure 15:
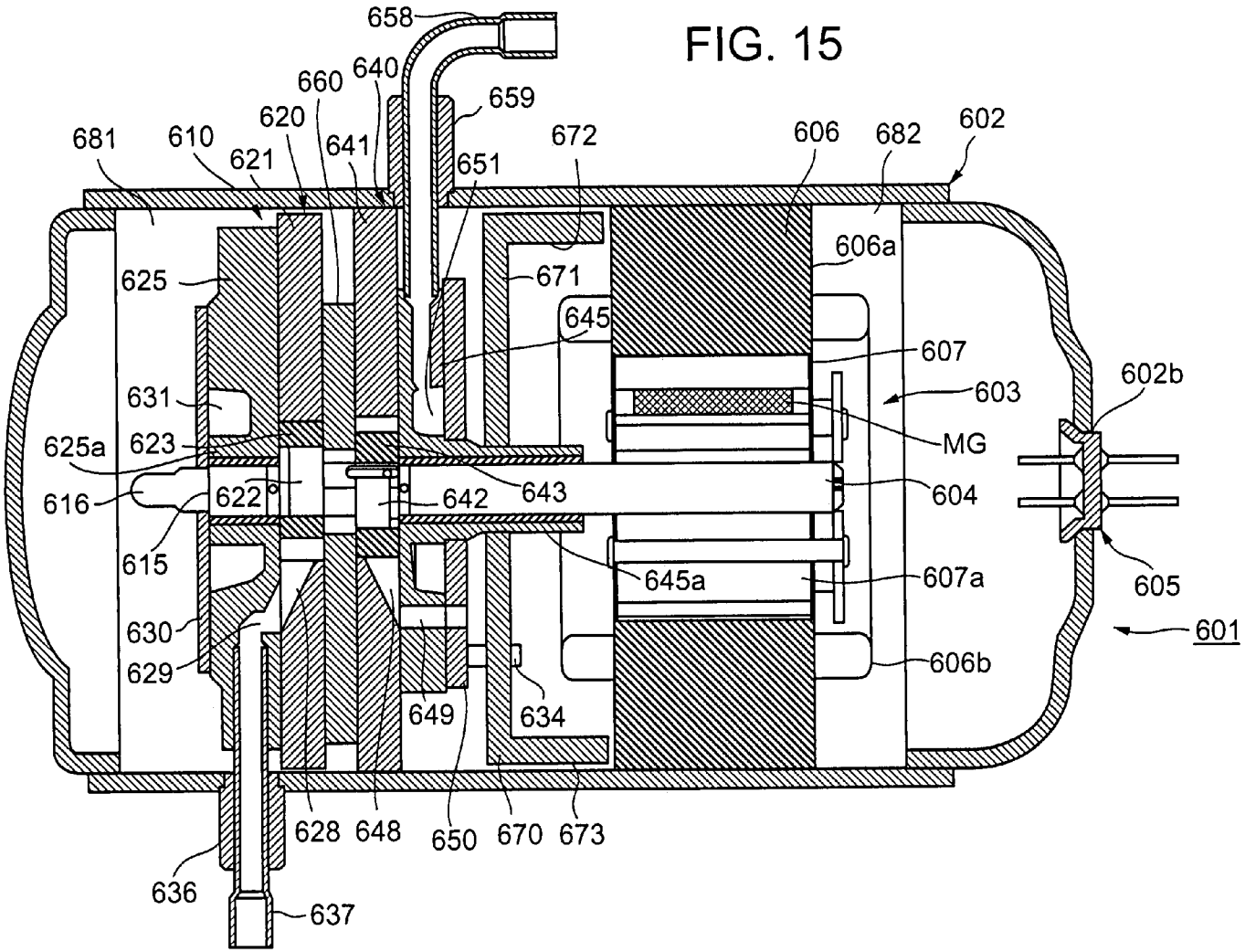
FIG. 15 is a sectional plan view of the horizontal type rotary compressor of the 2-stage compression system.

Next, yet another embodiment of the present invention will be described. FIG. 14 is a vertical section side view of a horizontal type rotary compressor of a 2-stage compression system of the embodiment, and FIG. 15 is a sectional plan view of the same.

The horizontal type rotary compressor 601 of the 2-stage compression system of the embodiment is an internal intermediate pressure horizontal type rotary compressor of the 2-stage compression system which uses carbon dioxide ($CO_2$) for a refrigerant, and comprises an airtight container 602. A bottom part of the airtight container 602 is an oil reservoir 602*a*. Then, the airtight container 602 contains a motor 603, and a rotary compression mechanism section 610 directly connected to a rotary shaft 604 of the motor 603 to be driven.

The carbon dioxide which is a natural refrigerant is selected in consideration of friendliness to a global environment, combustibility, toxicity and the like. As refrigerating machine oil suited to the natural refrigerant, for example, existing refrigerating machine oil such as mineral oil (mineral refrigerating machine oil), alkylbenzene oil, ether oil, ester oil, or polyalkyl glycol (PAG) is sealed in the airtight container 602.

The airtight container 602 is formed into a long-sideways cylindrical shape both ends of which are sealed, and a circular attaching hole 602*b* is formed in an end of the motor 603 side. A terminal 605 is fixed to the attaching hole 602*b* to supply power to the motor 603.

The motor 603 comprises a rotary shaft 604, a stator 606 annularly attached along an inner peripheral surface of the airtight container 602, and a rotor 607 inserted and installed by setting a slight space inside the stator 606.

A pump mechanism 615 is formed as oil supplying means in an end of the rotary compression mechanism section 610 side of the rotary shaft 604. The pump mechanism 615 draws up refrigerating machine oil from an oil reservoir 602*a* formed in a bottom part of the airtight container 602, and supplies this refrigerating machine oil to a sliding part of the rotary compression mechanism section 610 to prevent abrasion thereof. Additionally, the pump mechanism 615 comprises a refrigerating machine oil suction pipe 616 to draw up the refrigerating machine oil from the bottom part of the airtight container 602. This refrigerating machine oil suction pipe 616 comprises an opening 616*a* in a position directly lowered from the pump mechanism 615 to the oil reservoir 602*a*.

The stator 606 has a laminated body 606*a* formed by staking doughnut-shaped electromagnetic steel plates, and a stator coil 606*b* wound on a tooth part of the laminated body 606*a* by a series winding (concentrated winding) method. The rotor 607 is constituted of an electromagnetic steel plate laminated body 607*a* as in the case of the stator 606, and a permanent magnet MG is inserted therein. The rotor 607 is fixed to the rotary shaft 604 extended in an axial direction of the airtight container 602.

The rotary compression mechanism section 610 comprises first and second stage compression elements 620 and 640 driven by the rotary shaft 604 of the motor 603. In the airtight container 602, the first and second stage compression elements 620, 640 are arranged in this order from one side (left sides in FIGS. 14 and 15). The first and second stage compression elements 620 and 640 comprise an intermediate partition plate 660, cylinders 621, 641 of the first and second stage compression elements arranged on left and right sides of the intermediate partition plate 660, eccentric parts 622, 642 of the first and second stage compression elements disposed in the rotary shaft 604 with a phase difference of 180°, rollers 623, 643 fitted to the eccentric parts 622, 643 of the same to be eccentrically rotated in the cylinders 621, 641, vanes 624, 644 respectively abutted on the rollers 623, 643 thereof to divide the insides of the cylinders 621, 641 into low-pressure chamber sides and high-pressure chamber sides, and supporting members 625, 645 which close an opening surface of an opposite side of the motor 603 of the cylinder 621 and an opening surface of the motor 603 side of the cylinder 641. Bearings 625*a*, 645*a* for the rotary shaft 604 are formed in the supporting members 625, 645.

Springs 626, 646 are disposed outside the vanes 624, 644 (lower side in FIG. 14), which are abutted on outer ends of the vanes 624, 644 to always press the same to the rollers 623, 643 side. Further, on the airtight container 602 side of the springs 626, 646, metal plugs 627, 647 are disposed to prevent pulling-out thereof. Back pressure chambers (not shown) are formed in the vanes 624, 644, and pressure of a high-pressure chamber side of thereof is applied as back pressure to the back pressure chambers.

As shown in FIG. 15, the supporting members 625, 645 include suction passages 629, 649 communicated through suction ports 628, 648 with low-pressure chamber sides in the cylinders 621, 641, and discharge muffling chambers 631, 651 formed by partially recessing the members 625, 645 and closing the recessed parts with covers 630, 650.

The inside of the airtight container 602 of the horizontal type rotary compressor 601 of the 2-stage compression system is divided by a baffle plate 670 made of a steel plate into a compressor chamber 681 to house the rotary compression mechanism section 610 and a motor chamber 682 to house the motor 603.

The baffle plate 670 is formed into a cup shape which comprises a disk partition part 671 to divide the airtight container 602 into two, and a wall part 672 extended from the partition part 671 to the motor 603 side. Additionally, this baffle plate 670 is fixed between the wall part 672 and the airtight container 602 by tack-welding, and a small aperture 673 is formed between the wall part 672 and an inner surface of the airtight container 602. A tip of the wall part 672 is extended as close as possible to the stator 606 of the motor 603.

The discharge muffling chamber 631 of the first stage compression element 620 is communicated with the inside of the motor chamber 682 by an intermediate discharge pipe 634 of the first stage compression element 620 which penetrates the cylinders 621, 641, the intermediate partition plate 660, the cover 650, and the baffle plate 670.

The second stage compression element 640 is constituted to suck a gas refrigerant of the compressor chamber 681 into the cylinder 641 thereof through the suction passage 649 opened in the compressor chamber 681.

A suction pipe 637 of the first stage compression element 620 is pulled through a sleeve 636 attached to a side of the supporting member 625 on the side face of the airtight container 602 to the outside thereof. A discharge pipe 658 of the second stage compression element 640 is pulled through a sleeve 659 attached to a side of the supporting member 645 on the side face of the airtight container 602 to the outside thereof.

Incidentally, attaching pedestals 602*d* are disposed in both ends of the bottom part of the airtight container 602 in a longitudinal direction (see FIG. 14).

Next, an operation of the horizontal type rotary compressor 601 of the 2-stage compression system of the foregoing constitution will be described.

To begin with, when the stator coil 606*b* of the motor 603 is energized through a terminal 605 and a wiring (not shown), the motor 603 is started to rotate the rotor 607. This rotation is accompanied by rotation of the eccentric parts 622, 642 integrally disposed with the rotary shaft 604, and the rollers 623, 643 fitted to the eccentric parts 622, 642 are eccentrically rotated in the cylinders 621, 641.

Accordingly, a refrigerant of a refrigerant circuit (not shown) connected to the outside of the horizontal type rotary compressor 601 of the 2-stage compression system is passed through the suction pipe 637, the suction passage 629 and the suction port 628 of the first stage compression element 620, and sucked into the low-pressure chamber side of the cylinder 621 of the first stage compression element 620. The gas refrigerant sucked into the low-pressure chamber side of the cylinder 621 is compressed by operating the roller 623 and the vane 624 to become intermediate pressure, and discharged through the intermediate discharge pipe 634 into the motor chamber 682 in the airtight container 602.

The gas refrigerant of the intermediate pressure discharged to the motor chamber 682 contains refrigerating machine oil. The refrigerating machine oil contained in the gas refrigerant of the intermediate pressure is separated in the motor chamber 682 to be stored in the oil reservoir 602*a* in the bottom part thereof.

The gas refrigerant discharged into the motor chamber 682 is subjected to refrigerant machine oil separation, and then flows through the aperture 673 formed between the wall part of the baffle plate 670 and the inner surface of the airtight container 602 into the compressor chamber 681.

The gas refrigerant of the intermediate pressure that has flowed into the compressor chamber 681 is sucked through the suction passage 649 opened in the compressor chamber 681 into the cylinder 641 of the second stage compression element 640. Then, the gas refrigerant is subjected to compression of a second stage by rotating the roller 643 and the vane 644 to become a high-pressure and high-temperature gas refrigerant, and then discharged through a discharge port (not shown), the discharge muffling chamber 651 formed in the supporting member 645, and the discharge pipe 658 to the external refrigerant circuit (not shown).

Since such a flow of a refrigerant is formed, the separation operation of the refrigerating machine oil in the motor chamber 682 can be efficiently carried out without any direct suction of the discharged gas of the intermediate pressure from the first stage compression element 620 to the second stage compression element 640.

As described above, in the airtight container 602, a flow of a refrigerant is generated through the aperture 673. By forming the aperture 673 to a proper size, proper differential pressure can be generated between left and right sides of the baffle plate 670, i.e., between the motor chamber 682 and the compressor chamber 681. Thus, pressure of the motor chamber 682 is set higher than that of the compressor chamber 681.

Such a proper pressure difference generated between the motor chamber 682 and the compressor chamber 681 causes the refrigerating machine oil separated in the motor chamber 682 and stored in the oil reservoir 602*a* thereof to flow through the aperture 673 of the bottom part into the compressor chamber 681 side.

Figure 16A:
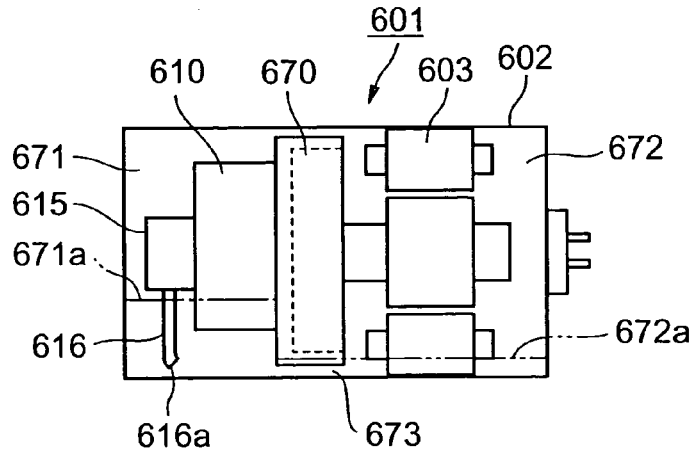
FIGS. 16A to 16C are views showing oil surface states of an oil reservoir in the horizontal type rotary compressor of the 2-stage compression system.

Thus, in a horizontally held state of the horizontal type rotary compressor 601 of the 2-stage compression system, an oil surface 681*a* of the refrigerating machine oil of the compressor chamber 681 side becomes higher compared with an oil surface 682*a* of the motor chamber 682 side as shown in FIG. 16A. Accordingly, since an opening 616*a* of the refrigerating machine oil suction pipe 616 is dipped in the refrigerating machine oil without any problems, the refrigerating machine oil is smoothly supplied to a sliding part of the rotary compression mechanism section 610 by the pump mechanism 615.

Figure 16B:
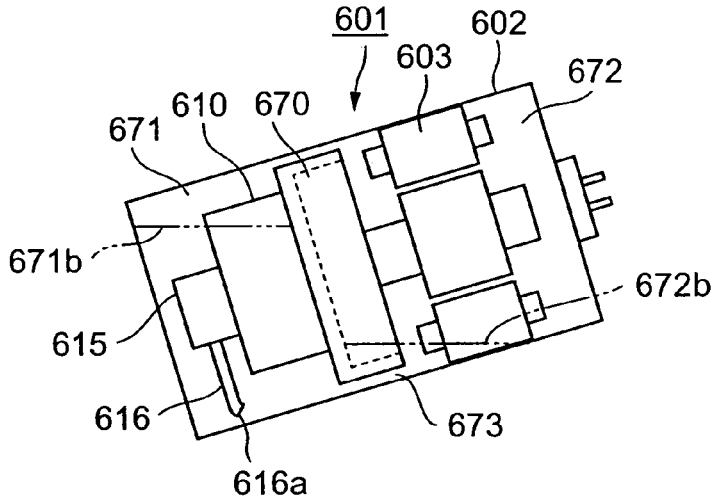

Next, when the horizontal type rotary compressor 601 of the 2-stage compression system is inclined from the horizontal state to the rotary compression mechanism section 610 side as shown in FIG. 16B, since the compression chamber 681 is located in a lower part, the refrigerating machine oil of the motor chamber 682 further flows through the aperture 673 into the compressor chamber 681 side. As a result, a refrigerating machine oil amount of the motor chamber 682 is reduced, and an oil surface 681*b* of the compressor chamber 681 becomes higher than that in the state of FIG. 16A. Thus, in this case, drawing-up of the refrigerating machine oil is smoothly carried out. Incidentally, a reference numeral 682*b* in FIG. 16B denotes an oil surface of the motor chamber 682 in the inclined state.

Figure 16C:
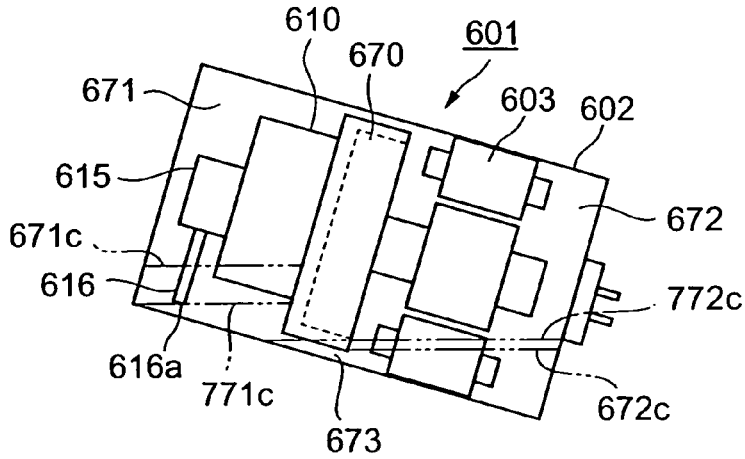

When the horizontal type rotary compressor 601 of the 2-stage compression system is inclined from the horizontal state to the motor 603 side as shown in FIG. 16C, since the compressor chamber 681 is located above the motor chamber 682, the refrigerating machine oil of the compressor chamber 682 flows through the aperture 673 in the bottom part of the airtight container 602 to the motor chamber 682 side, whereby an oil surface 682*c* of the motor chamber 682 is increased to at least a height of the aperture 673. However, according to the embodiment, since a tip of the aperture 673 approaches the stator 606 of the motor 603, an amount of refrigerating machine oil stored in the motor chamber 682 can be reduced more than that in the case of forming the baffle plate 670 into a flat plate shape.

That is, if the baffle plate 670 is formed into a circular flat plate shape, as shown in FIG. 16C, an oil surface of the motor chamber 682 side becomes high as denoted by 772*c* to increase an amount of refrigerating machine oil left therein. Thus, an oil surface 771*c* of the compressor chamber 681 side becomes low to reduce an amount of oil left therein. On the other hand, according to the embodiment, since the baffle plate 670 is formed into a cup shape, an oil surface 672*c* of the motor chamber 682 side becomes low to reduce an amount of oil. An oil surface 671*c* of the compressor chamber 681 side becomes high to increase an amount of oil therein. As a result, the opening 616*a* of the refrigerating machine oil suction pipe 616 can be maintained below the oil surface 681*c*, and thus drawing-up of the refrigerating machine oil can be smoothly carried out.

Depending on use, the horizontal type rotary compressor 601 of the 2-stage compression system may be inclined to one of the rotary compression mechanism section 610 side or the motor 603 side, and strong vibration may be applied thereto from the outside, whereby the oil surfaces 681*a*, 681*b*, and 681*c* of the compressor chamber 681 side may be greatly changed up and down. However, because of the aforementioned constitution in which the oil surfaces 681*a*, 681*b*, and 681*c* of the compressor chamber 681 side become high, there is little danger that the opening 616*a* will jump above the oil surfaces 581*a*, 581*b*, and 681*c*.

According to the horizontal type rotary compressor 601 of the 2-stage compression system of the embodiment, even if it is inclined to one of the rotary compression mechanism section 610 side and the motor 603 side, further even if strong vibration is applied from the outside in addition to the inclination, it is possible to draw up the refrigerating machine oil as long as the inclination and the vibration are not excessive.

Thus, even if the horizontal type rotary compressor 601 of the 2-stage compression system of the embodiment is applied to an automobile air conditioner of large inclination and vibration, sufficient refrigerating machine oil can be drawn up. Moreover, sufficient refrigerating machine oil can be supplied to the rotary compression mechanism section 610 without increasing an amount of refrigerating machine oil sealed in the airtight container 602.

According to the embodiment, the carbon dioxide ($CO_2$) is used for the refrigerant. However, the invention is not limited to this refrigerant. The invention can be implemented by using hydrocarbon (HC), ammonium ($NH_3$) or the like.

The embodiment has been described by taking the example of the horizontal type rotary compressor 601 of the 2-stage compression system. However, the invention is not limited to this example. The invention can be applied to a horizontal type rotary compressor of a multistage compression system in which the rotary compression mechanism 610 has 3, 4, or more stages.

According to the embodiment, the baffle plate 670 is formed into the cup shape which comprises the circular partition part 671, and the wall part 672 extended from the partition part 671 to the motor 603 side. However, the wall part 672 needs not to be formed on a full circumference of the inner wall of the airtight container 602, but it only needs to be formed to a height to be dipped in the refrigerating machine oil. Therefore, the baffle plate 670 needs not to be always formed into the cup shape. Incidentally, if the baffle plate 670 is formed into the cup shape as described above, angle positioning of an inner peripheral direction of the airtight container 602 can be made unnecessary to facilitate manufacturing when the baffle plate 670 is attached thereto. Additionally, if the baffle plate 670 has a cup shape, the object of the invention can be achieved even when the partition part 671 is rotated for one reason or another.

The horizontal type rotary compressor of the multistage compression system of the invention can be used for a home air conditioner, a business air conditioner (package air conditioner), an automobile air conditioner, a heat pump system water heater, a home refrigerator, a business refrigerator, a business freezer, a business refrigerator-freezer, an automatic vending machine, and the like.

Thus, the horizontal type rotary compressor of the embodiment comprises the baffle plate disposed between the rotary compression mechanism section and the motor to divide the inside of the airtight container into the compressor chamber to house the rotary compression mechanism section and the motor chamber to house the motor, and is constituted in such a manner that the discharged gas refrigerant of the first stage compression element is discharged into the motor chamber, and the gas refrigerant which flows from the motor chamber into the compressor chamber is sucked into the second stage compression element. Thus, a gas refrigerant of intermediate pressure discharged from the first stage compression element to the motor chamber is not directly sucked into the second stage compression element, and refrigerating machine oil is easily separated therefrom. The pressure of the motor chamber becomes higher than that of the compressor chamber, whereby the oil surface of the compressor chamber can be increased. Additionally, when the compressor is inclined to the motor side, the refrigerating machine oil stays therein at least until the oil surface touches the aperture. However, this amount is reduced by the partition part and the wall part of the baffle plate compared with the case of forming the baffle plate into a flat plate shape of only a partition plate.

That is, by constituting the baffle plate of the partition plate and the wall part, and extending the wall part to the motor side, the tip of the aperture formed between the wall part and the inner surface of the airtight container can be brought close to the motor side. As a result, an amount of refrigerating machine oil until the oil surface touches the aperture can be greatly reduced compared with the case of the flat plate shape. Thus, according to the horizontal type rotary compressor of the multistage compression system, when the compressor is inclined, the refrigerating machine oil left in the motor chamber side can be suppressed to accordingly increase the refrigerating machine oil left in the compressor chamber side. Moreover, it is possible to reduce refrigerating machine oil for filling by increasing the refrigerating machine oil left in the compressor chamber side.

Furthermore, an automobile air conditioner of the present invention uses the horizontal type rotary compressor of the multistage compression system which can be run in the inclined state as described above. Thus, the compressor can be applied to an automobile air conditioner of violent vibration. Moreover, since a carbon dioxide gas is used for a refrigerant, it is possible to provide an automobile air conditioner excellent in global environment preservation.

What is claimed is:

1. A horizontal type compressor which comprises a compression mechanism section constituted of first and second rotary compression elements, discharges a refrigerant compressed by the first rotary compression element into an airtight container, and further compresses the discharged refrigerant of intermediate pressure by the second rotary compression element to discharge the refrigerant, wherein an oil supply passage is formed in an intermediate partition plate held between cylinders of the first and second rotary compression elements to communicate a low-pressure chamber of the cylinder of the second rotary compression element with a bottom part in the airtight container; and wherein the oil supply passage is opened in a slope of a suction port formed to be inclined in the cylinder of the second rotary compression element.

2. A horizontal type compressor which comprises a compression mechanism section constituted of first and second rotary compression elements, discharges a refrigerant compressed by the first rotary compression element into an airtight container, and further compresses the discharged refrigerant of intermediate pressure by the second rotary compression element to discharge the refrigerant, wherein an oil supply passage is formed completely in a cylinder of the second rotary compression element to communicate a low-pressure chamber of the cylinder with a bottom part in the airtight container, and wherein the oil supply passage is opened in a slope of a suction port formed to be inclined in the cylinder of the second rotary compression element.

3. The horizontal type compressor according to claim 2, wherein a notch is formed in a cylinder bottom part of the second rotary compression element and the oil supply passage is opened in the notch.

4. A horizontal type compressor comprising:

an airtight container in a bottom part of which an oil reservoir is formed to store refrigerating machine oil;

a rotary compression mechanism section which includes a first stage compression element and a second stage compression element sequentially arranged from one side of the airtight container, and which is arranged in the airtight container;

a motor arranged on the other side of the second stage compression element in the airtight container to directly interconnect and drive the first and second stage compression elements;

a baffle plate which divides the inside of the airtight container into a compressor chamber to house the rotary compression mechanism section and a motor chamber to house the motor in a state of penetrating an end of a bearing of the second stage compression element;

a refrigerant passage which permits distribution of a refrigerant from the motor chamber to the compressor chamber;

a refrigerating machine oil passage which permits distribution of refrigerating machine oil from the motor chamber to the compressor chamber; and a refrigerating machine oil collecting member made of a permeable material and disposed between the bearing and the motor partially in contact with an end surface of the bearing of the second stage compression element, wherein the first stage compression element has an intermediate discharge pipe constituted to spray a discharged gas refrigerant toward the refrigerating machine oil collecting member in the motor chamber, and the second stage compression element has a suction passage formed to suck a gas refrigerant from the compressor chamber.

* * * * *